US009433305B2

(12) United States Patent
Bird et al.

(10) Patent No.: US 9,433,305 B2
(45) Date of Patent: Sep. 6, 2016

(54) PRODUCT MERCHANDISER

(71) Applicants: Gregory M. Bird, Solon, OH (US); Gerald Matthew Szpak, Brecksville, OH (US); Shane Obitts, Elyria, OH (US); Michael Eric Liedtke, Kent, OH (US); Matthew Grubbs, Union, KY (US)

(72) Inventors: Gregory M. Bird, Solon, OH (US); Gerald Matthew Szpak, Brecksville, OH (US); Shane Obitts, Elyria, OH (US); Michael Eric Liedtke, Kent, OH (US); Matthew Grubbs, Union, KY (US)

(73) Assignee: Fasteners For Retail, Inc., Twinsburg, OH (US)

( * ) Notice: Subject to any disclaimer, the term of this patent is extended or adjusted under 35 U.S.C. 154(b) by 0 days.

(21) Appl. No.: 14/180,163

(22) Filed: Feb. 13, 2014

(65) Prior Publication Data

US 2014/0263112 A1 Sep. 18, 2014

Related U.S. Application Data

(60) Provisional application No. 61/790,030, filed on Mar. 15, 2013, provisional application No. 61/808,014, filed on Apr. 3, 2013, provisional application No. 61/871,049, filed on Aug. 28, 2013.

(51) Int. Cl.

| | |
|---|---|
| ***A47F 1/04*** | (2006.01) |
| ***A47F 3/02*** | (2006.01) |
| ***A47F 5/00*** | (2006.01) |

(Continued)

(52) U.S. Cl.

CPC . *A47F 1/04* (2013.01); *A47F 1/12* (2013.01); *A47F 3/02* (2013.01); *A47F 5/005* (2013.01); *A47F 7/285* (2013.01)

(58) Field of Classification Search

CPC ..... A47F 1/04; A47F 3/02; A47F 7/285; A47F 1/12; A47F 5/005

USPC ..... 211/59.2–59.4, 184; 221/311, 307, 310; 108/108

See application file for complete search history.

(56) References Cited

U.S. PATENT DOCUMENTS

| | | | |
|---|---|---|---|
| 314,436 | A | 3/1885 | Crocker |
| 1,877,050 | A | 9/1932 | Ray |
| 2,446,788 | A | 8/1948 | Rifkin |

(Continued)

FOREIGN PATENT DOCUMENTS

| | | |
|---|---|---|
| CA | 2 725 928 | 6/2011 |
| EP | 0 004 921 A1 | 10/1979 |
| EP | 0 568 396 A1 | 11/1993 |

OTHER PUBLICATIONS

International Search Report and Written Opinion of International Application No. PCT/US2014/016516 dated May 27, 2014, 17 pages.

(Continued)

*Primary Examiner* — Joshua J Michener
*Assistant Examiner* — Devin Barnett
(74) *Attorney, Agent, or Firm* — Fay Sharpe LLP

(57) ABSTRACT

A retainer assembly for an associated merchandising structure includes a planar divider mounted to the associated merchandising structure with the divider including a first side, a second side, a front end and a rear end. A first retainer is pivotally mounted to a first side of the divider adjacent the front end thereof. A second retainer is pivotally mounted to the second side of the divider adjacent the front end thereof. The first and second retainers are biased into an orientation normal to the plane of the divider. Each of the first and second retainers is adapted to pivot omnidirectionally in relation to the plane of the divider.

17 Claims, 21 Drawing Sheets

(51) Int. Cl.
*A47F 7/28* (2006.01)
*A47F 1/12* (2006.01)

(56) References Cited

U.S. PATENT DOCUMENTS

| | | | | | |
|---|---|---|---|---|---|
| 2,460,396 | A | | 2/1949 | Rifkin | |
| 2,480,339 | A | | 8/1949 | Rifkin | |
| 2,522,896 | A | | 9/1950 | Rifkin et al. | |
| 2,572,090 | A | * | 10/1951 | Allen | 211/49.1 |
| 2,605,907 | A | | 8/1952 | Hirst | |
| 3,923,159 | A | | 12/1975 | Taylor et al. | |
| 4,395,955 | A | * | 8/1983 | Pfeifer | 108/61 |
| 4,640,560 | A | | 2/1987 | Blum | |
| 4,785,943 | A | * | 11/1988 | Deffner et al. | 211/59.2 |
| 5,205,421 | A | * | 4/1993 | Bustos | 211/59.2 |
| D337,674 | S | * | 7/1993 | Ozawa | D6/675 |
| 5,232,102 | A | * | 8/1993 | Ozawa | 211/49.1 |
| 5,417,333 | A | | 5/1995 | Flum | |
| 5,542,552 | A | | 8/1996 | Yablans et al. | |
| 5,570,811 | A | * | 11/1996 | Wittern et al. | 221/127 |
| 5,806,689 | A | | 9/1998 | Mays et al. | |
| 6,142,317 | A | | 11/2000 | Merl | |
| 6,253,954 | B1 | | 7/2001 | Yasaka | |
| 6,428,123 | B1 | | 8/2002 | Lucht et al. | |
| 6,513,667 | B2 | | 2/2003 | Battaglia et al. | |
| 7,124,898 | B2 | | 10/2006 | Richter et al. | |
| 7,150,365 | B2 | | 12/2006 | Hardy et al. | |
| 7,641,072 | B1 | | 1/2010 | Vlastakis et al. | |
| 7,690,519 | B2 | | 4/2010 | Kahl et al. | |
| 7,743,932 | B2 | * | 6/2010 | Lynch | 211/184 |
| 7,823,734 | B2 | | 11/2010 | Hardy | |
| 7,854,333 | B2 | * | 12/2010 | Kottke et al. | 211/59.2 |
| 8,056,734 | B2 | | 11/2011 | Menz et al. | |
| 8,152,006 | B2 | | 4/2012 | Wamsley et al. | |
| 8,469,205 | B1 | | 6/2013 | Hardy | |
| 2003/0160060 | A1 | * | 8/2003 | Hornblad et al. | 221/256 |
| 2003/0166374 | A1 | * | 9/2003 | Nelson | A63H 3/04 446/379 |
| 2004/0020877 | A1 | | 2/2004 | Boron | |
| 2004/0140279 | A1 | | 7/2004 | Mueller et al. | |
| 2005/0127014 | A1 | * | 6/2005 | Richter et al. | 211/59.2 |
| 2005/0189310 | A1 | * | 9/2005 | Richter et al. | 211/59.3 |
| 2005/0218094 | A1 | * | 10/2005 | Howerton et al. | 211/59.3 |
| 2005/0279722 | A1 | * | 12/2005 | Ali | 211/59.3 |
| 2006/0196840 | A1 | * | 9/2006 | Jay et al. | 211/59.2 |
| 2006/0207950 | A1 | | 9/2006 | Kiehnau et al. | |
| 2006/0237384 | A1 | * | 10/2006 | Neumann et al. | 211/184 |
| 2007/0119799 | A1 | * | 5/2007 | Hanretty et al. | 211/59.2 |
| 2007/0170127 | A1 | | 7/2007 | Johnson | |
| 2007/0256992 | A1 | * | 11/2007 | Olson | 211/59.3 |
| 2007/0267364 | A1 | * | 11/2007 | Barkdoll | 211/59.3 |
| 2007/0267366 | A1 | * | 11/2007 | Howerton et al. | 211/59.3 |
| 2008/0011696 | A1 | * | 1/2008 | Richter et al. | 211/59.2 |
| 2008/0121595 | A1 | * | 5/2008 | Trulaske | 211/59.2 |
| 2009/0101606 | A1 | * | 4/2009 | Olson | 211/59.3 |
| 2009/0236491 | A1 | * | 9/2009 | Rizzo | 248/623 |
| 2009/0277924 | A1 | | 11/2009 | Kottke et al. | |
| 2010/0050134 | A1 | * | 2/2010 | Clarkson | 715/863 |
| 2011/0089125 | A1 | | 4/2011 | Roeske | |
| 2011/0147323 | A1 | * | 6/2011 | Sainato et al. | 211/59.2 |
| 2011/0163113 | A1 | * | 7/2011 | Grubbs et al. | 221/311 |
| 2012/0091090 | A1 | * | 4/2012 | Larsen et al. | 211/184 |
| 2012/0103922 | A1 | | 5/2012 | Bird et al. | |
| 2012/0261367 | A1 | * | 10/2012 | Kabakci | 211/59.2 |
| 2013/0075352 | A1 | * | 3/2013 | Mitten et al. | 211/59.2 |
| 2014/0034590 | A1 | * | 2/2014 | Szpak et al. | 211/59.2 |
| 2014/0034591 | A1 | * | 2/2014 | Szpak et al. | 211/59.2 |
| 2014/0049851 | A1 | * | 2/2014 | Snell et al. | 359/871 |
| 2014/0190917 | A1 | * | 7/2014 | Szpak et al. | 211/134 |
| 2014/0299559 | A1 | * | 10/2014 | Bird et al. | 211/59.2 |
| 2014/0323012 | A1 | * | 10/2014 | Sopinsky et al. | 446/330 |
| 2014/0332482 | A1 | * | 11/2014 | Hardy | 211/59.3 |
| 2014/0338647 | A1 | * | 11/2014 | Cummings | 124/20.3 |
| 2015/0041418 | A1 | * | 2/2015 | Grubbs et al. | 211/59.3 |
| 2015/0053631 | A1 | * | 2/2015 | Hardy | 211/59.3 |
| 2015/0150387 | A1 | | 6/2015 | Turner et al. | |

OTHER PUBLICATIONS

FFR-DSI Yellow Pages 2010 Product Catalog, cover page, pp. 231, 241 and 246.

* cited by examiner

PRODUCT MERCHANDISER

This application claims the benefit of Provisional Application Ser. No. 61/790,030 which was filed on Mar. 15, 2013; Provisional Application Ser. No. 61/808,014 which was filed on Apr. 3, 2013; and, Provisional Application Ser. No. 61/871,049 which was filed on Aug. 28, 2013. The entire contents of those applications are incorporated hereinto by reference.

BACKGROUND

The present disclosure concerns a product dispensing system employed in point of sale merchandising.

The present disclosure relates particularly to shelving systems for feeding containers forward. More specifically, it relates to retaining members that are mounted to divider assemblies which can be employed in modular gravity fed shelving systems, such as for fragile products including individual thin-walled containers of refrigerated foods such as yogurt. Yogurt is typically sold in individual cups or containers in supermarkets and the like. Traditionally, yogurt is sold in refrigerator cases which can include generally horizontal shelves, on which a customer needs to pull the product forward if the product is not at the front of the shelf, or on somewhat downwardly slanted shelves, which feed product forward by gravity. It should be appreciated that pusher assemblies can also be employed to urge yogurt containers or other product containers such as cream cheese, butter or sour cream containers or tubs forward on a shelf. Many such containers have planar bases and planar tops so that they can be stacked two or three high on merchandising shelves.

Gravity feed systems are known to move products towards the front of a shelf display or storage case. While it is known to gravity feed yogurt and the like refrigerated dairy products towards the front end of a display case, the currently known retainers positioned at the front end of such shelves are not optimal. More specifically, it is known to provide tabs or like blocking elements or retainers attached to opposing side walls or dividers mounted on the shelf to define a channel for holding a column of product. Such tabs are not particularly sturdy and may become damaged. Since these blocking elements are generally fastened to the dividing wall, the replacement of the tabs may necessitate the replacement of the divider wall itself. Thus, a need exists for a shelving system which would allow the replacement of such blocking elements without the need of replacing the divider wall itself. In other words, there is a need for blocking elements which are selectively detachable from the divider wall to which they are attached.

A need also exists for a shelving system in which the divider walls are so mounted to the display shelf that they do not move laterally as product is either withdrawn from the shelf or restocked on the shelf. Thus, a need exists for a shelving system which would allow the stocking, display and sale of various products including dairy items held in containers, which would overcome the deficiencies of prior art shelving systems.

BRIEF DESCRIPTION OF THE DISCLOSURE

In accordance with one embodiment of the present disclosure, there is provided a retainer assembly for an associated merchandising structure comprising a divider mounted to the associated merchandising structure, a first retainer mounted to a first side of the divider, and a second retainer mounted to a second side of the divider, wherein each of the first and second retainers is biased into an orientation normal to a plane of the divider, and each of the first and second retainers is adapted to pivot omnidirectionally in relation to the plane of the divider.

In another embodiment, the present disclosure relates to a retainer assembly for a merchandising structure having a support surface, the retainer assembly comprising a first divider mounted to an associated support structure and a second divider mounted to the associated support structure, wherein the first and second dividers are spaced from each other and define between them a longitudinal pathway or channel along which an associated item of merchandise can travel from a rear position to a front position on the associated support structure. A first finger is mounted to the first divider and second finger is mounted to the second divider so that the first and second fingers face each other. The first and second fingers are independent of each other and are each movable to a plurality of positions such that in a first position they are adapted to extend normal to the pathway and at least partially obstruct the pathway thereby retarding further forward movement of the associated item of merchandise, in the second position they are adapted to move omnidirectionally at an acute angle in relation to the pathway to allow further forward movement of the associated item of merchandise for removal of same from the associated shelf, and in a third position they are adapted to move omnidirectionally at an acute angle in relation to the pathway to allow a restocking of the associated item of merchandise on the associated support structure.

In accordance with yet another embodiment of the present disclosure, there is provided a retaining member for an associated merchandising assembly which includes a support surface and a divider supported on the support surface, the retaining member comprising a first portion including a first base and a first body mounted on and extending away from the first base. A second portion includes a second base and a second body mounted on an extending away from the second base. A biasing member resiliently connects the first portion to the second portion, wherein the first base and the second base are adapted to assume a first position in relation to each other for mounting the retaining member to the divider of the associated merchandising assembly, and adapted to assume a second position for securing the retaining member to the divider of the associated merchandising assembly.

BRIEF DESCRIPTION OF THE DRAWINGS

The present invention may take physical from in certain parts and arrangements of parts, several embodiments of which will be described in detail in this specification and illustrated in the accompanying drawings which from a part hereof and wherein.

DETAILED DESCRIPTION

It should be understood that the description and drawings herein are merely illustrative and that various modifications and changes can be made in the structures disclosed, without departing from the scope of the present disclosure. It should also be appreciated that the various identified components of the product merchandising systems discussed herein are merely terms of art and that these may vary from one manufacturer to another. Such terms should not be deemed to limit the present disclosure.

Figure 1:
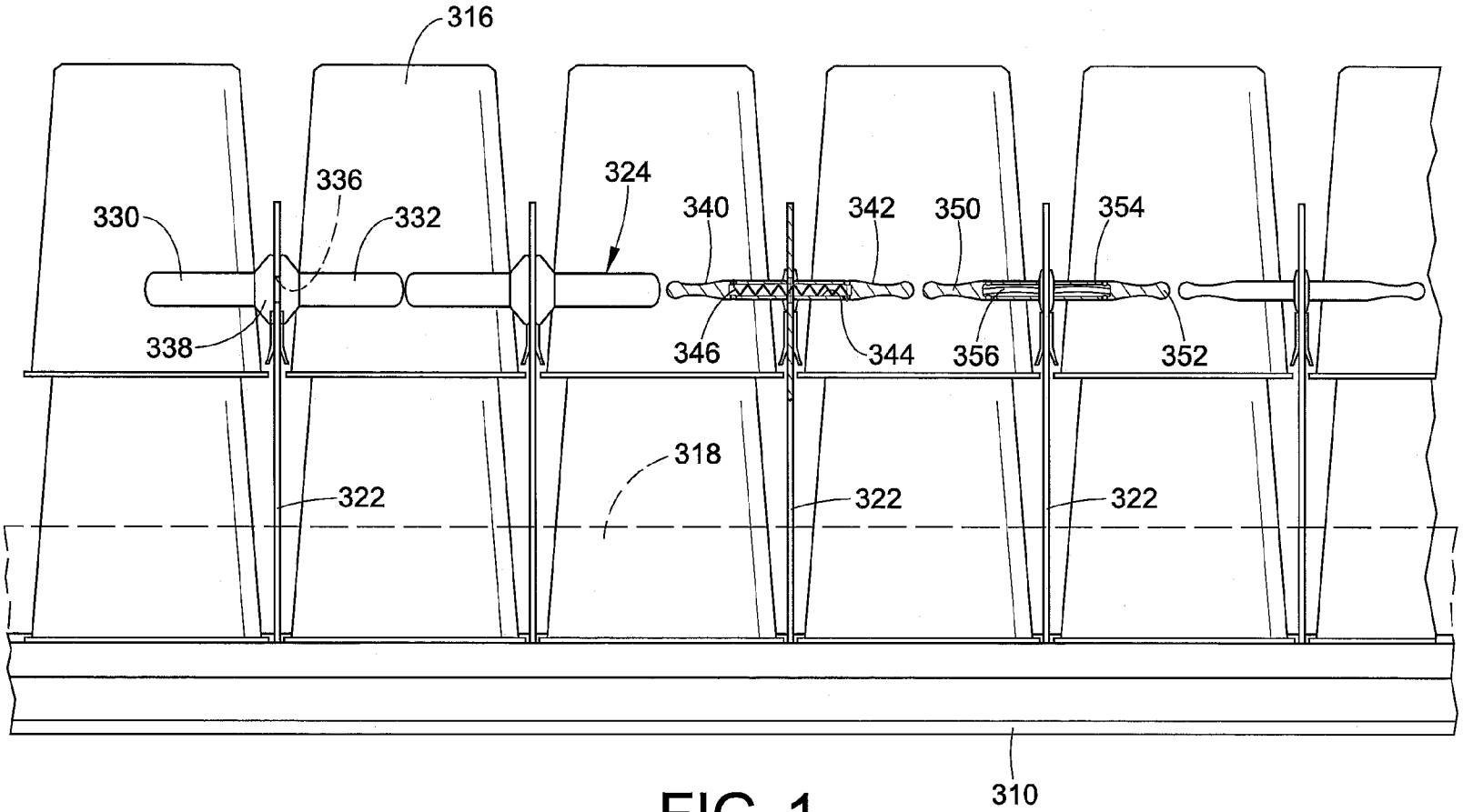
FIG. 1 is a front elevational view of one embodiment of a product merchandiser according to the present disclosure illustrating several different types of movable retainers.

With reference now to FIG. 1, disclosed is a shelf 310 on which are positioned a plurality of food product containers such as yogurt containers 316 stacked such that a first, lower, layer is covered by a second, upper, layer. A front fence 318 is attached to the shelf 310 and serves as a barrier to retard forward movement of the lower layer of containers. The containers are divided into columns by side walls or dividers 322. Movable retainers 324 are attached to the dividers and serve to retard forward movement of the upper layer of containers 316.

A variety of types of movable retainers are disclosed. In a first, one piece, design, a pair of retaining fingers 330 and 332 extend on the two sides of a first divider 322. The fingers, which are made of a resilient material, such as a thermoplastic or thermoset material, extend through either side of an aperture 336 defined in the divider. In this embodiment, the one piece retainer is pushed through the divider aperture 336 until one base portion 338 is located on each side of the divider.

In another embodiment of a movable retainer, there are provided first and second fingers 340 and 342 which are connected on respective sides of a second divider 322. Defined in the first and second fingers are respective cavities 344 which can accommodate respective springs 346 which can be connected to each other. In this embodiment, the two fingers are mounted to respective sides of the second divider 322. The springs 346 allow the two fingers to move as needed in relation to the divider. In the embodiment illustrated in FIG. 2, mounted on the divider 322 are a pair of bases 341. Each of the bases accommodates a respective finger 340 and 342. Disposed in the cavities 344 of the two fingers is a single spring 347 which extends through an aperture 348 in the divider 322.

Figure 2:
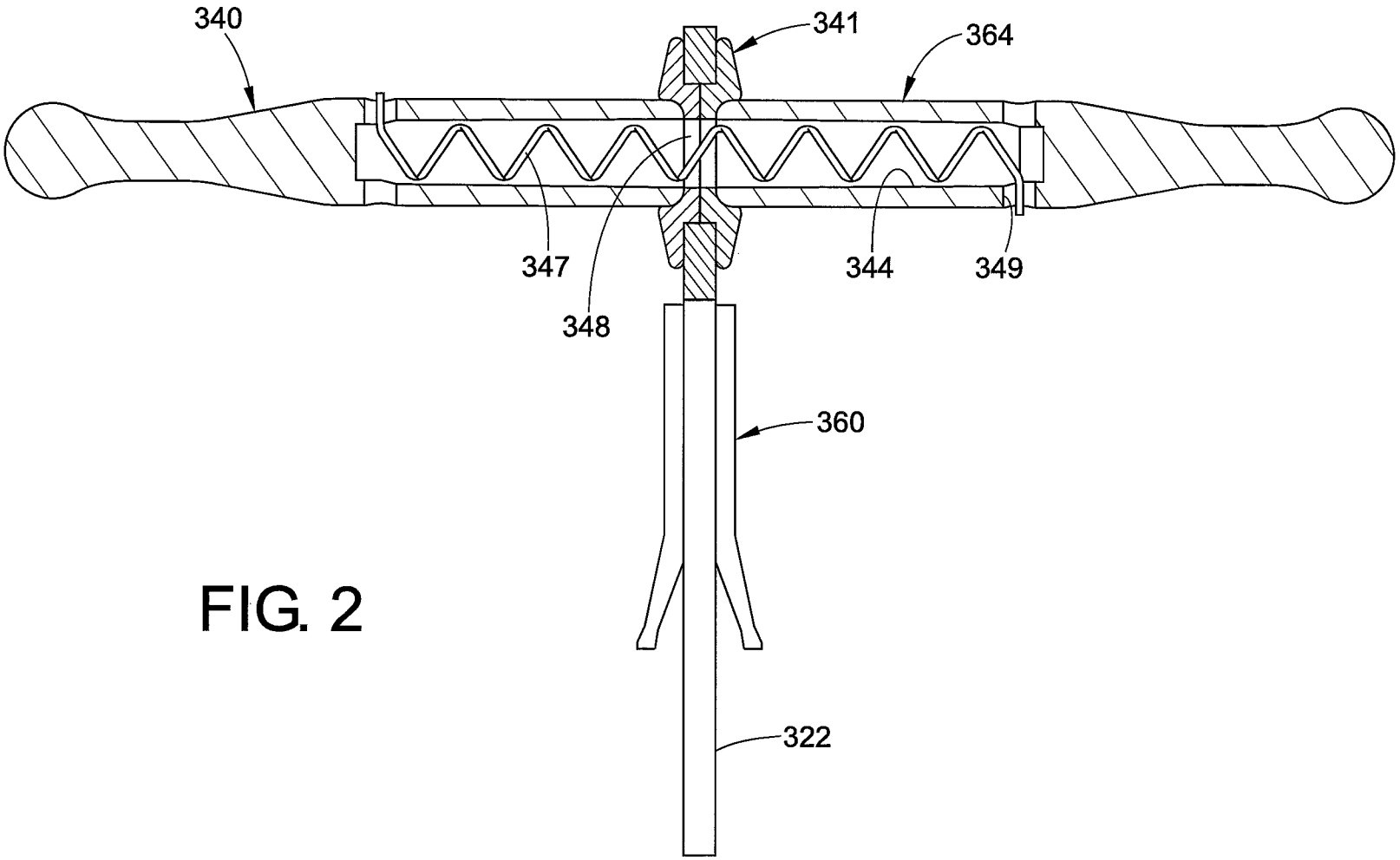
FIG. 2 is an enlarged front elevational view in partial cross-section of a portion of the product merchandiser of FIG. 1.

It should be appreciated that either respective springs, such as 346 illustrated in FIG. 1, or a single spring, such as 347 illustrated in FIG. 2 can be employed in connection with the movable retainer. In one embodiment, the springs 346 or 347 are tension springs. As is apparent from FIG. 2, the opposed ends of the spring 347 extend out or protrude through apertures 349 located in each of the fingers 340 and 342. The apertures 349 are located at the distal end of the respective cavity 344 in each of the fingers. The fingers 340 and 342 are thus free to move within the confinement of the base geometry and the tension of the springs or other resilient biasing members employed. An omnidirectional movement of the fingers 340, 342 is facilitated through the use of such biasing members. The bases 341 serve as sockets for accommodating movement of the fingers in various directions in relation to both the bases and the divider 322. Put another way, the fingers 340 and 342 can pivot omnidirectionally, forwardly and rearwardly as well as up and down or at a variety of angles in relation to the support surface on which the product containers are held.

Also disclosed in FIG. 1 is a third embodiment of a movable retainer. In this embodiment, there are provided first and second fingers 350 and 352. These extend on opposing sides of a third divider 322. Held within respective cavities 354 of the fingers are respective elastic bands 356. These bands serve to provide flexibility to the fingers so that they can move as is needed to either dispense food containers or other merchandise 316 from the shelf or to restock such containers if a customer decides that, on second thought, he or she does not wish to purchase the selected container.

Figure 3:
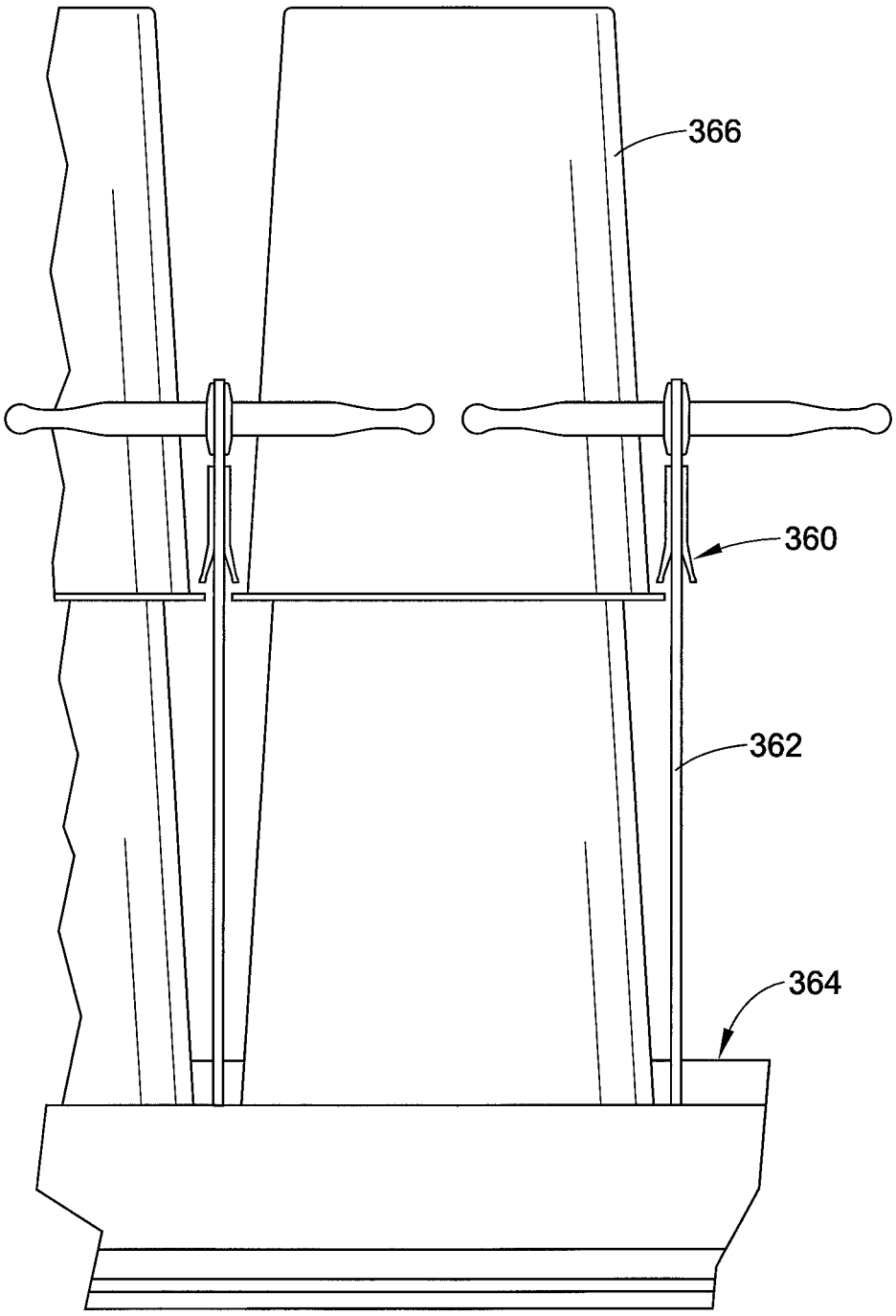
FIG. 3 is an enlarged front elevational view of a portion of the embodiment of FIG. 1.
Figure 4:
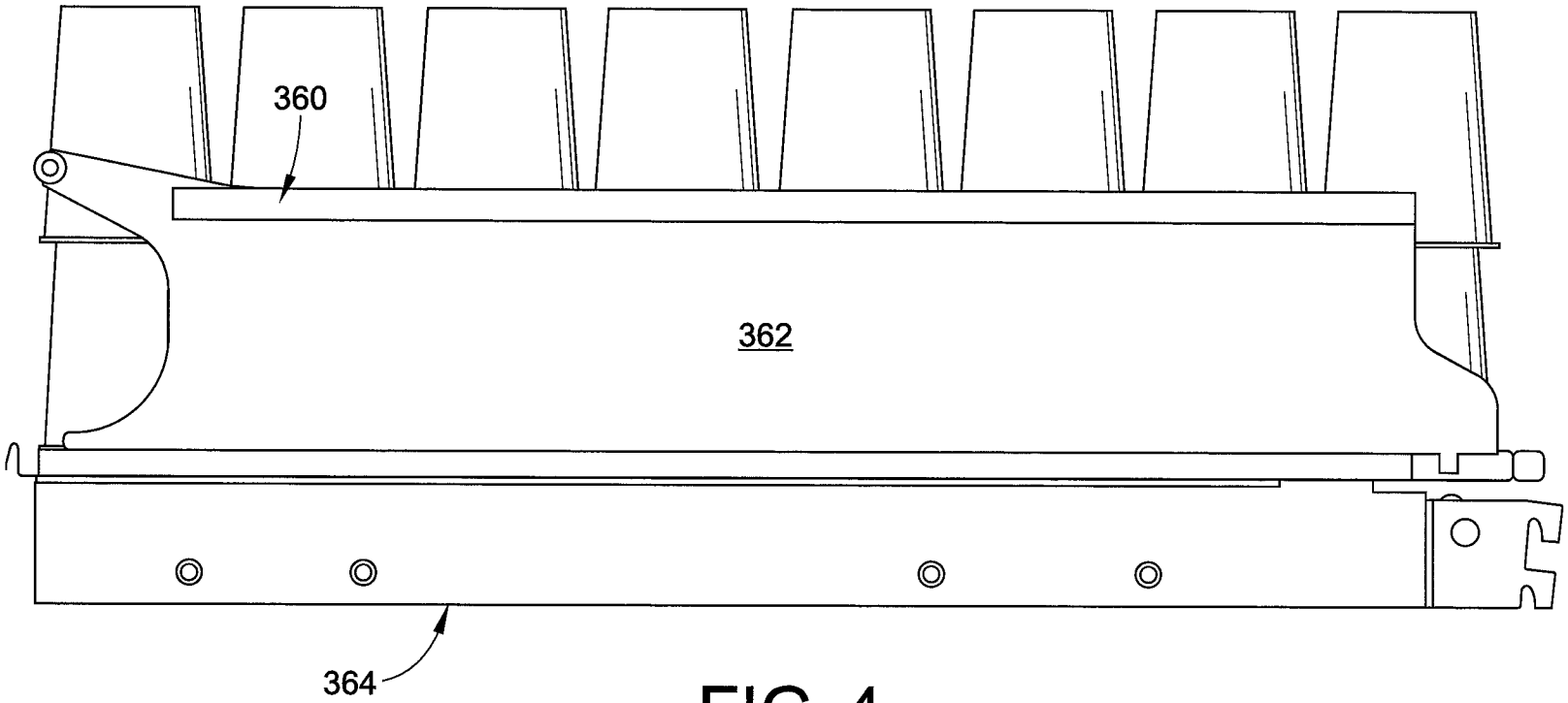
FIG. 4 is a side elevational view of a portion of the embodiment of FIG. 1.
Figure 5:
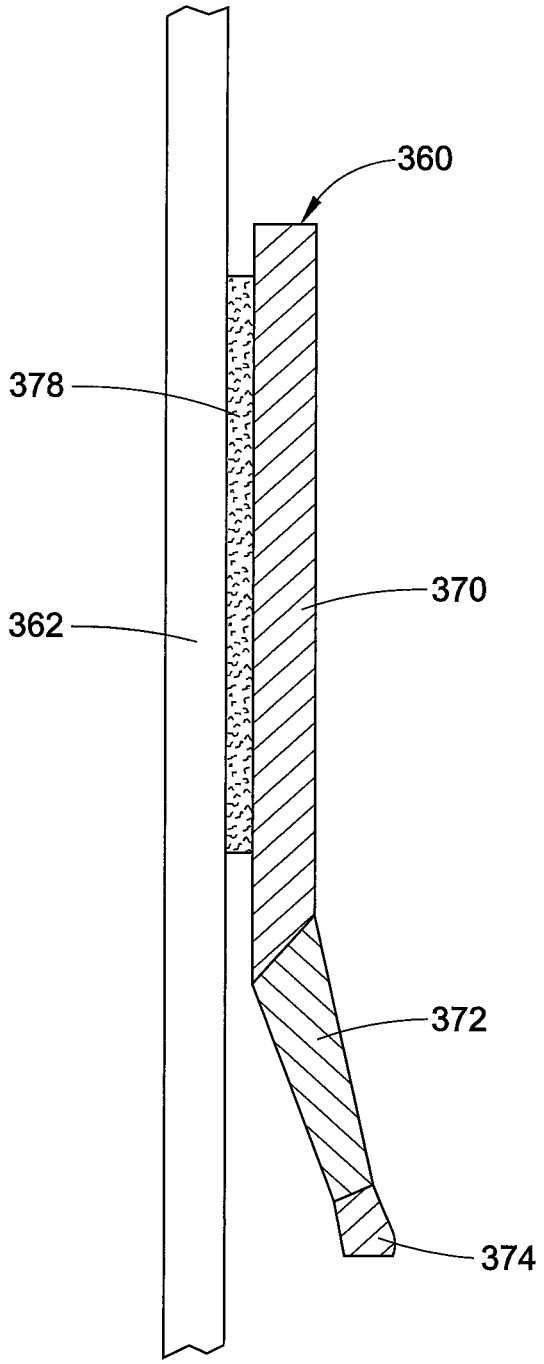
FIG. 5 is a greatly enlarged top plan view of a portion of the embodiment of FIG. 1.

With reference now to FIG. 3, an anti-tip guide 360 is mounted to a divider wall 362 held on a merchandising shelf 364. Product containers 366 are also held on the shelf 364. With reference now also to FIG. 4, it can be seen that the anti-tip guide extends along a significant portion of the length of the divider 362 from adjacent its rear end to adjacent its front end. With reference now also to FIG. 5, the anti-tip guide comprises a base or first portion 370, an arm or second section 372 and a free end or tip 374. In the design illustrated, both the base and the tip are made of a generally rigid thermoplastic material, such as PVC, whereas the arm 372 is made from a relatively flexible thermoplastic or thermoset material. In this way, the tip portion 374 of the anti-tip guide can be flexed away from its normal position and towards a divider wall 376 when it is desired to either add or remove product containers 364 from the shelf and will flex back to its normal position thereafter. The anti-tip guide 360 can be mounted to the divider wall 362 via a layer of adhesive 378 if so desired.

Figure 6:
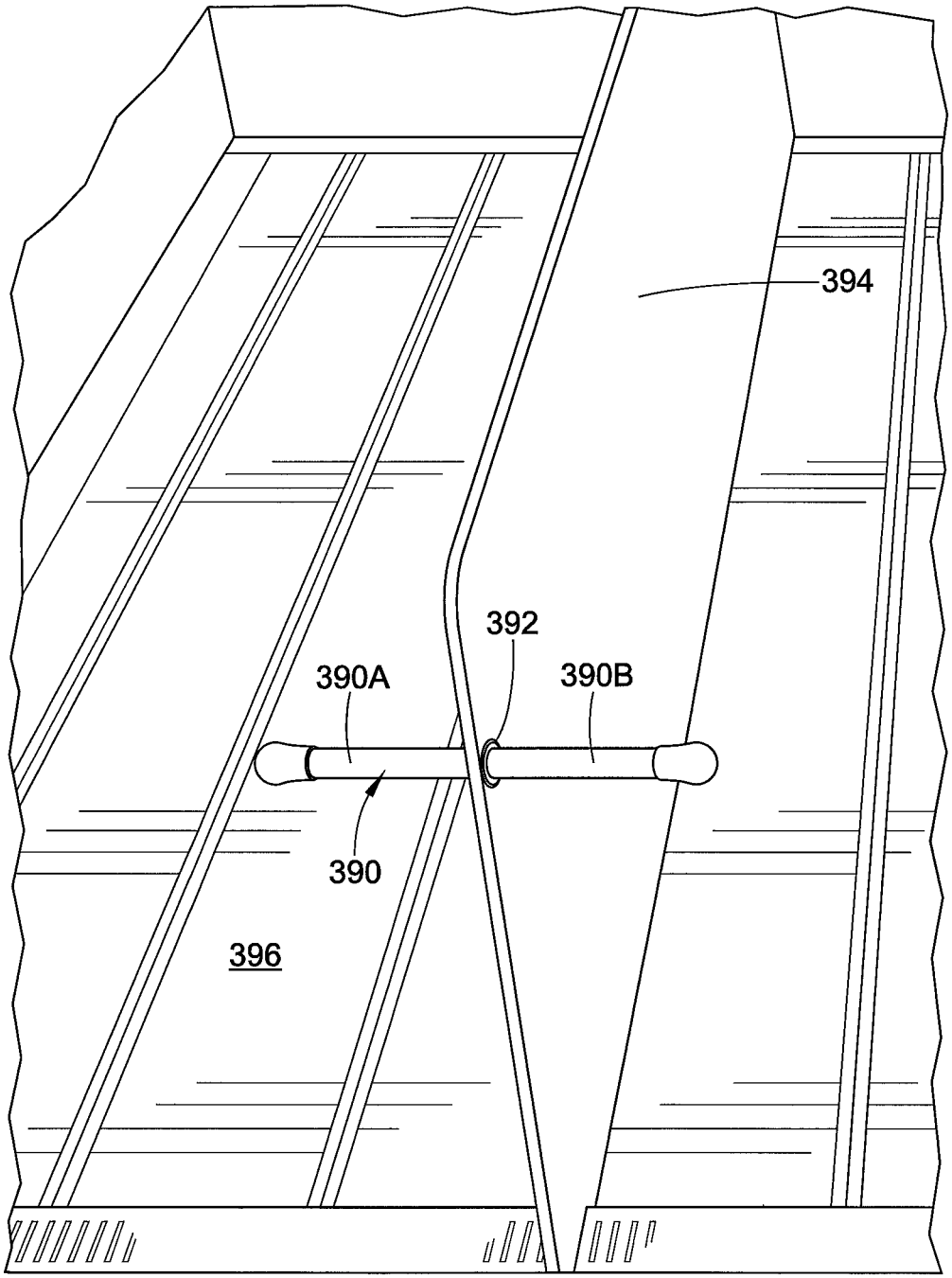
FIG. 6 is a perspective view of another embodiment of a product merchandiser according to the present disclosure.

With reference now to FIG. 6, disclosed is a further embodiment of a movable retainer. In this embodiment, a spring-like member 390 is pushed through an aperture 392 in a divider 394 so that about one half the member 390A, 390B is located on a respective side of the divider 394. Each half of the spring-like member can pivot or flex out of the way when access is desired to product being retained behind that member on a shelf 396 and will naturally flex back into position when it is no longer being pushed away from its normal orientation.

Figure 7:
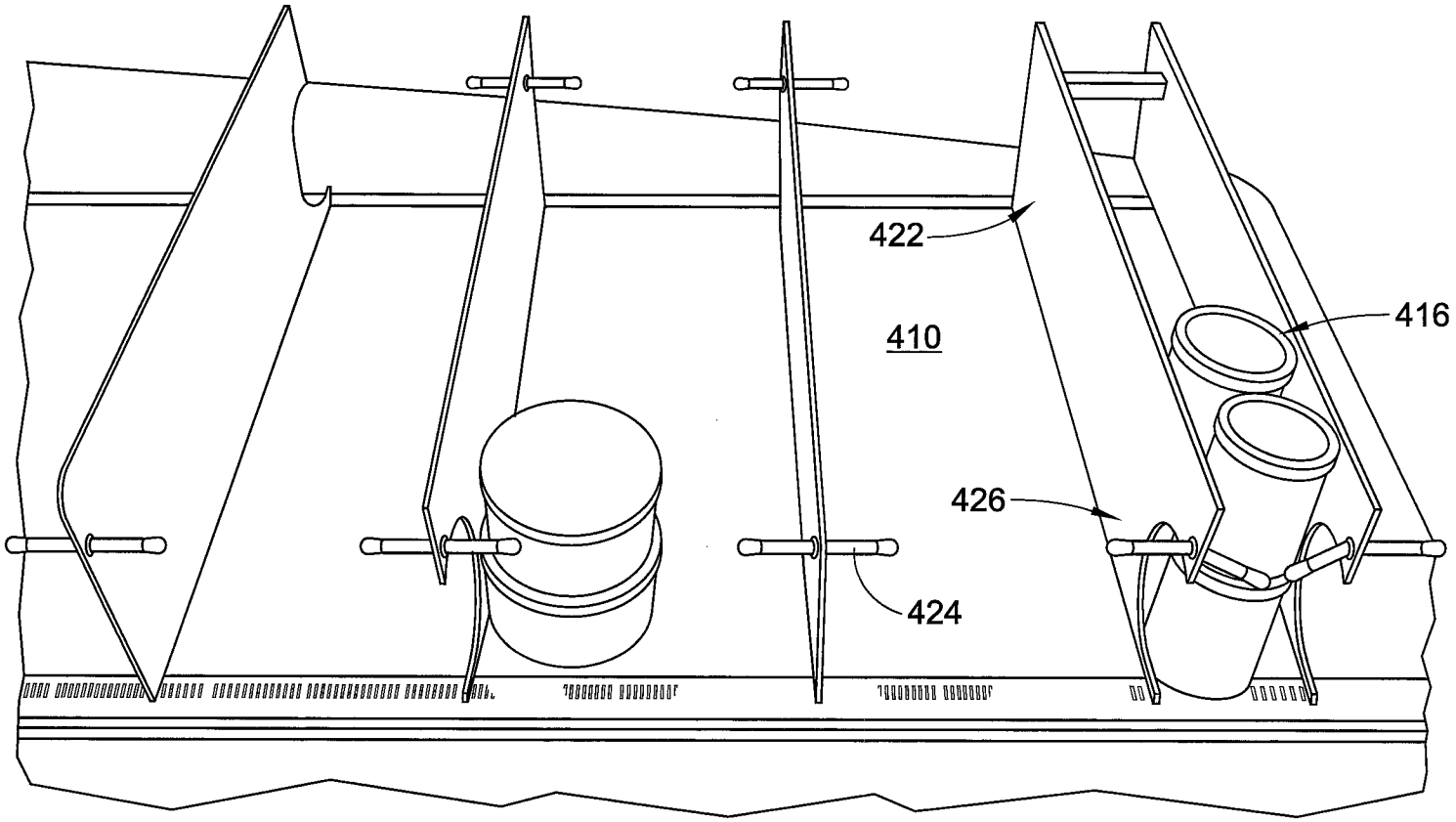
FIG. 7 is a perspective view of still another embodiment of a product merchandiser according to the present disclosure.
Figure 15:
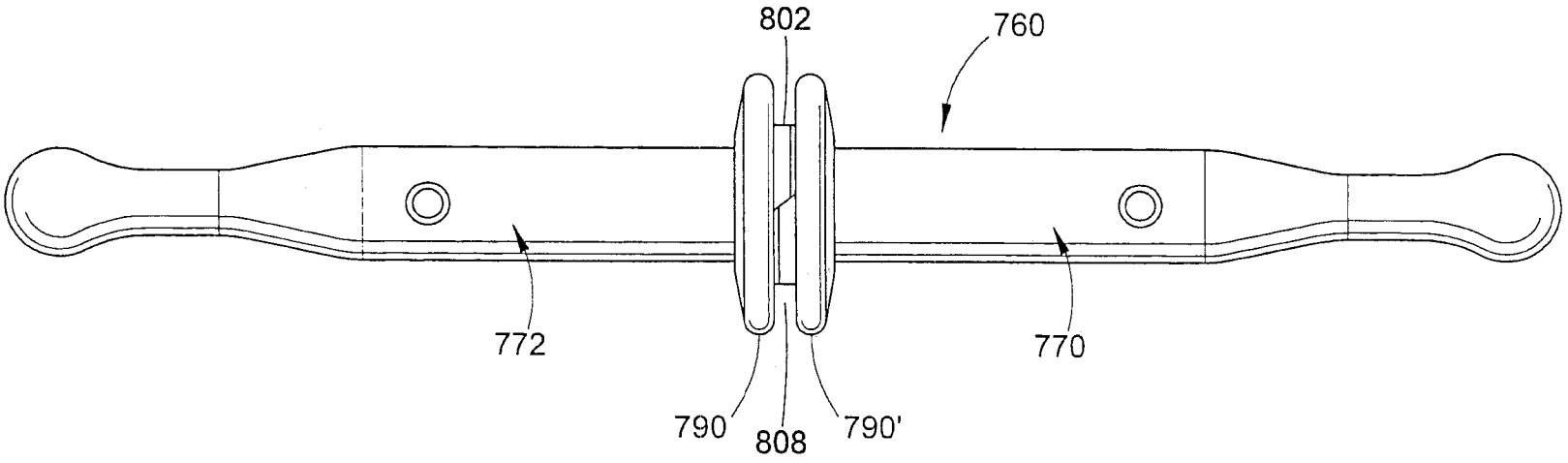
FIG. 15 is an assembled front elevational view of the retaining member of FIG. 14.

With reference now to FIG. 7, there is disclosed a further design of a movable retainer. In this design, a shelf 410 is provided with a plurality of dividers 422 for organizing product containers 416 into columns which may be double stacked as illustrated. The shelf 410 is gravity fed so that the containers will slide forward on the shelf. In order to prevent the containers from falling off the shelf, there is provided a movable retainer 424 in front of the upper level of product. Not illustrated is a fence or retainer to retard the lower level of product from falling off the shelf. The moderate flexing of the movable retainer in its normal "hold" position is illustrated in FIG. 15.

The movable retainers illustrated in FIGS. 1-7 are advantageous from the perspective that they can flex not only forwards but also rearwards because they are oriented, in a rest position, generally normal to an axis of the divider to which they are mounted. Furthermore, they can move pivotally or flex omnidirectionally at an acute angle in relation to the divider to which they are mounted. Such a design is useful in order to allow a potential customer to access product in the lower layer of product in the double stack arrangement illustrated. This is in contrast to prior designs in which retaining fingers only generally flex forward, flexed rearward with some difficulty and did not have the capability of flexing omnidirectionally. Therefore, such designs made it difficult, if not impossible, to access product on a lower layer or level of product held on a shelf and located behind a retaining wall, such as is commonly used in product merchandising in forward feed systems to prevent the product from falling off the shelf. A retaining arm with generally universal flexing ability in relation to the divider to which it is attached is greatly advantageous in terms of allowing access to products held on a shelf or support surface.

Figure 8:
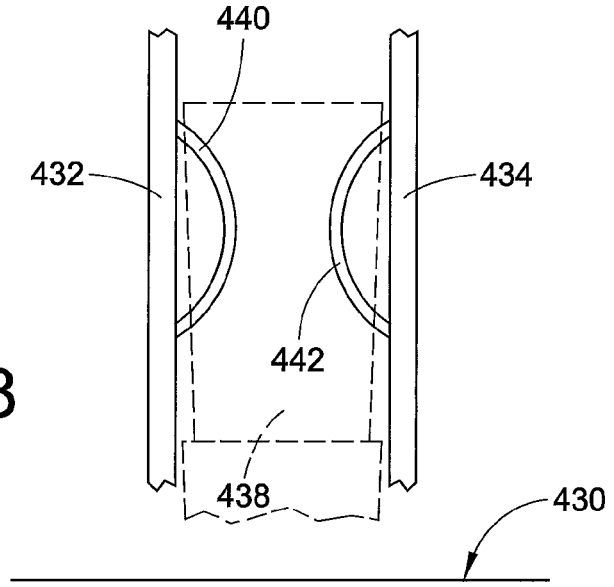
FIG. 8 is a schematic front elevational view of a further embodiment of a product merchandiser according to the present disclosure.

With reference now to FIG. 8, disclosed is a further design of a movable retainer system. In this design, mounted on a shelf 430 are first and second dividers 432 and 434 which are spaced far enough apart so as to accommodate a column of product, including product container 438. Disposed in front of a forward most one of a column of products are first and second barriers 440 and 442. In this design, the barriers can be flexible, tube-like, generally C-shaped members which are mounted in a vertical orientation adjacent the front end of each respective barrier. In other words, both ends of each barrier are secured to the same divider and each barrier extends vertically. In this design, the barriers can flex out of the way in order to allow withdrawal of a product container 438 and can flex back once such removal has been accomplished. Further, the barriers can flex backwardly to restock product on the shelf. It should be appreciated that the shelf could be a double layer shelf with the first and second barriers 440 and 442 located in front of an upper layer of product, with the lower layer of product being retained behind a front retaining wall or fence, as is known in the art. Alternatively, such barriers could be positioned in front of each layer of product held on a shelf.

Figure 9:
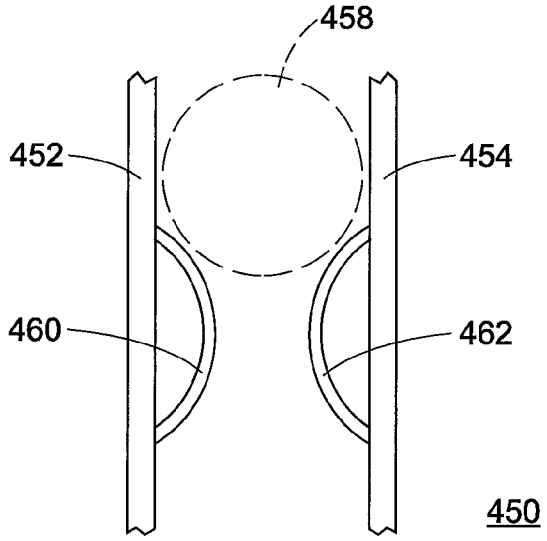
FIG. 9 is a schematic top plan view of yet another embodiment of a product merchandiser according to the present disclosure.
Figure 17:
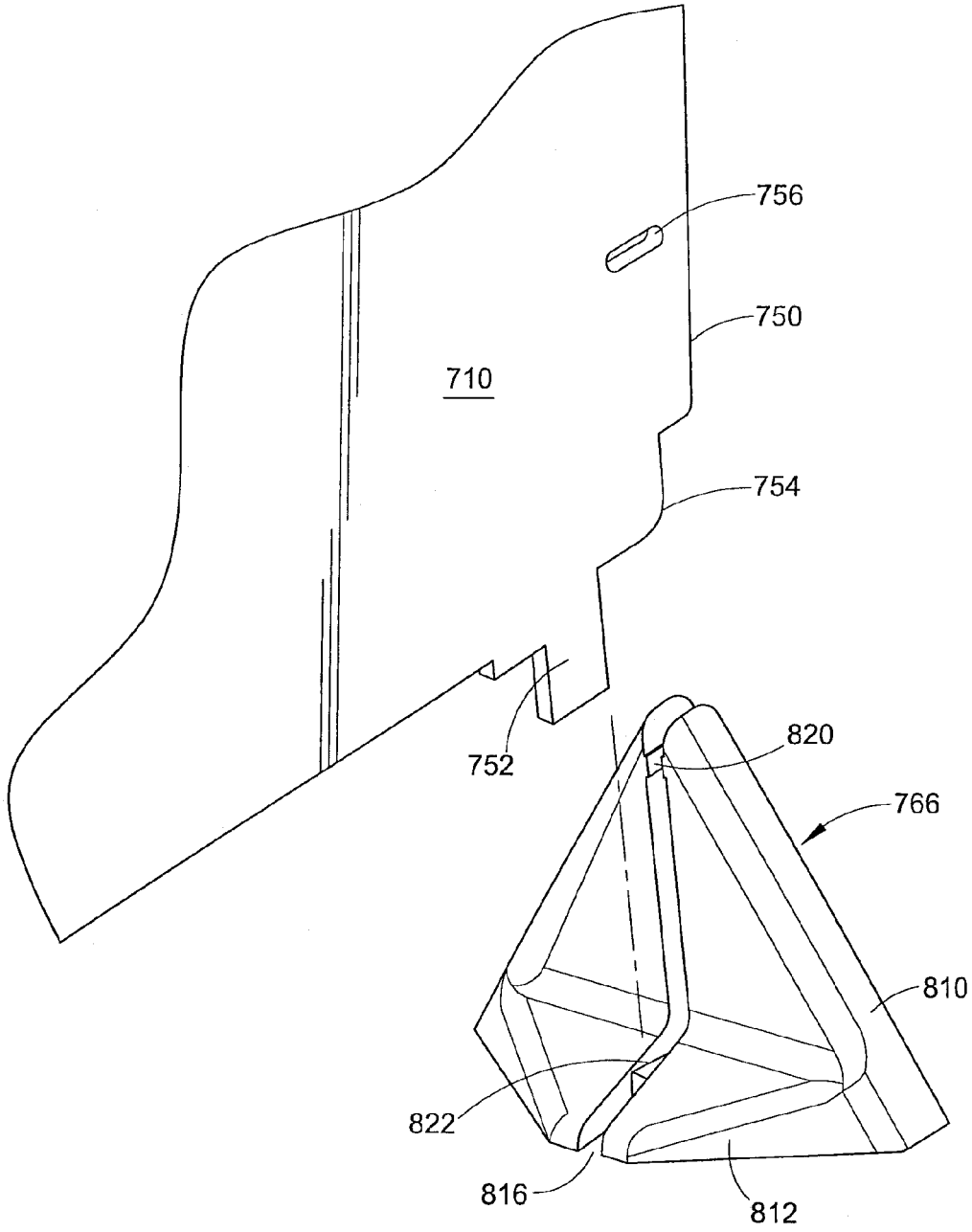
FIG. 17 is an enlarged fragmentary view of a rear portion of the divider assembly of FIG. 13.

With reference now to FIG. 9, there is disclosed a shelf 450 on which are mounted a pair of spaced dividers 452 and 454. Also held on the shelf 450 are a plurality of product containers 458, only one of which is illustrated. Disposed in front of the forward most product on the shelf are first and second barriers 460 and 462. These barriers are horizontally oriented, in contrast to the barriers illustrated in FIG. 17, and can be generally C-shaped in design and can be made from a flexible tube-like material such that the barriers can flex out of the way when needed in order to allow access to a product container 458 and will resiliently spring back to their normal position when no longer being interfered with. It should be appreciated that the product 458 is illustrated in FIG. 17 can be an upper layer of product, but could equally be a lower layer.

Figure 10:
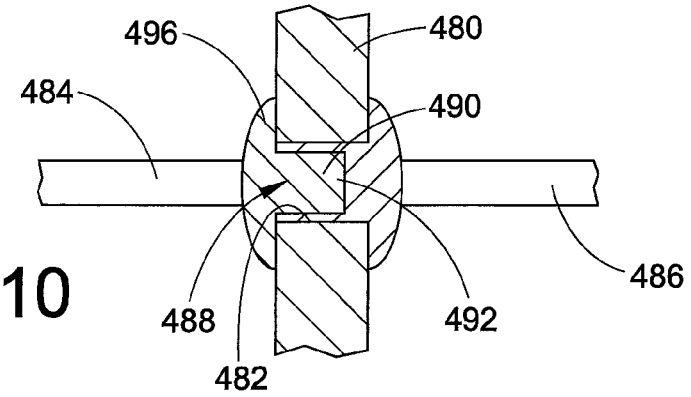
FIG. 10 is an enlarged cross sectional view partially broken away of a movable retainer system for product merchandisers according to an additional embodiment of the present disclosure.

Next, with reference to FIG. 10, there is disclosed a divider 480 which contains an aperture 482. Disposed on a left side of a barrier 480 is a first finger 484 and disposed on the right side is a second finger 486. An interconnect 488 between the fingers extends through the aperture 482. The interconnect can comprise a protrusion 490 extending from the first finger 484 and a socket 492 defined in the second finger 486. In this way, the first and second fingers 484 and 486 can be snapped to each other on respective sides of the divider 480. Covering the aperture 482 on a respective side of the divider 480 is a respective base 496 of the first and second fingers 484 and 486.

Figure 11:
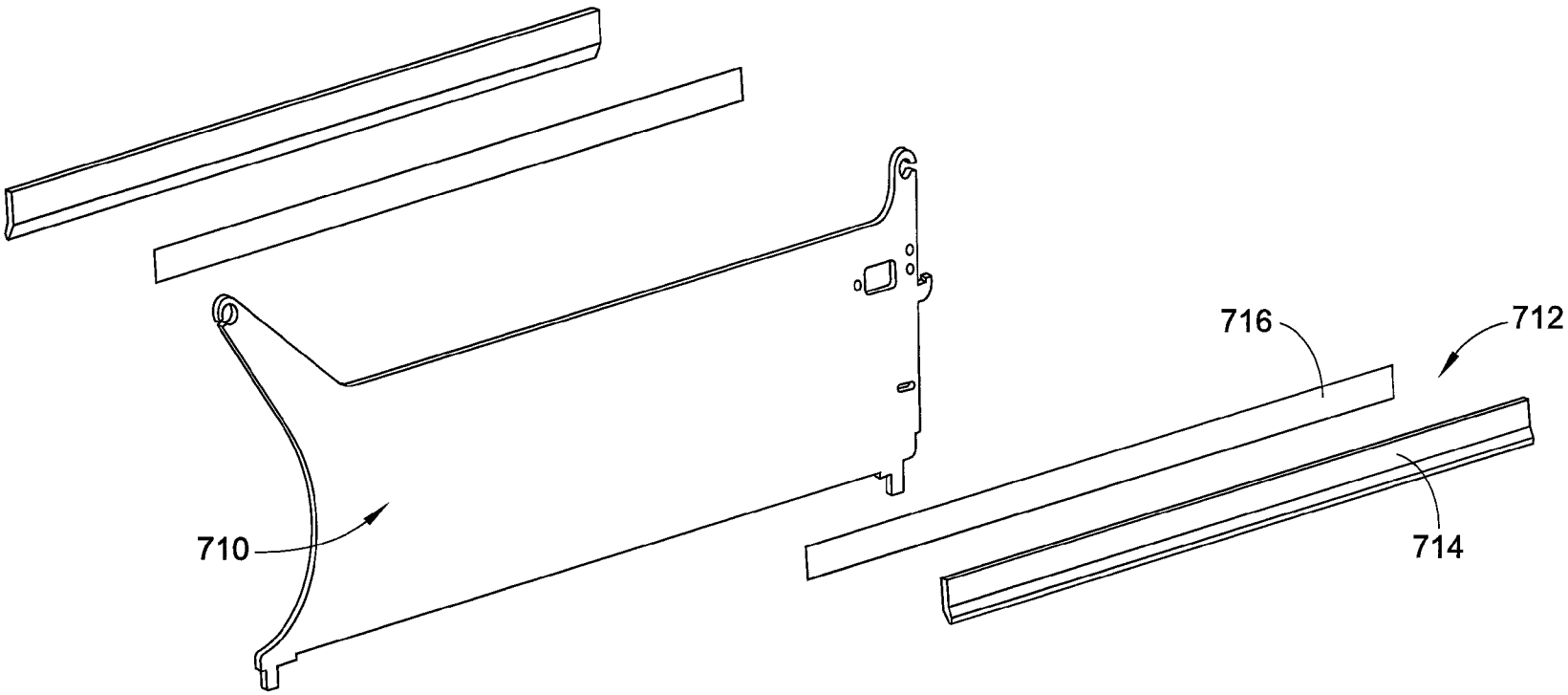
FIG. 11 is an exploded perspective view of a portion of a divider assembly of a product merchandiser according to yet still another embodiment of the present disclosure.

With reference to FIG. 11, the instant disclosure pertains to a divider assembly which includes a divider 710 to which can be mounted an anti tip guide 712. Two such guides are illustrated, one being mounted to each side of the divider 710. Each anti tip guide 712 includes a first section 714, which can be a coextrusion of a relatively rigid material and a relatively flexible material, and a second section 716, which may be an adhesive member such as double-sided tape.

Figure 12:
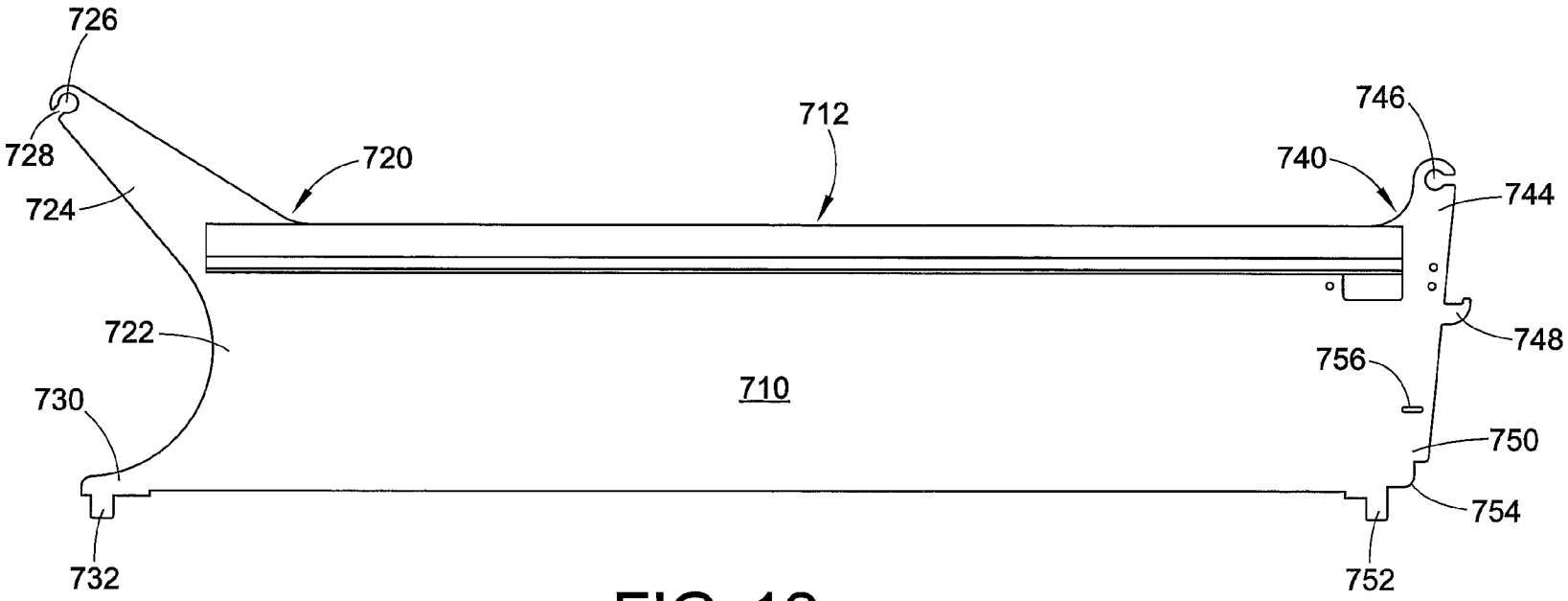
FIG. 12 is an assembled side elevational view of the divider assembly of FIG. 11.

With reference now to FIG. 12, the divider 710 includes a front end 720 comprising an indented front face 722 with a protruding upper portion 724. Defined on the upper portion is an opening or aperture 726 extending through the divider from one side face thereof to the other. Also provided is a slot 728 that extends between an exterior surface of the indented front face 722 and the opening 726. The front end 720 also includes a protruding lower portion 730. Extending away from the lower portion is a tab 732. The divider 710 also includes a rear end 740. The rear end includes a protruding upper portion 744 which comprises an opening 746 communicating with a slot. It also includes a protruding finger 748 that is generally centrally located on the rear end. The rear end further comprises a lower portion 750 from which extends or depends a finger 752. The rear end also includes an indented portion 754, as well as a slot 756 which is spaced from the indented portion and the finger.

Figure 13:
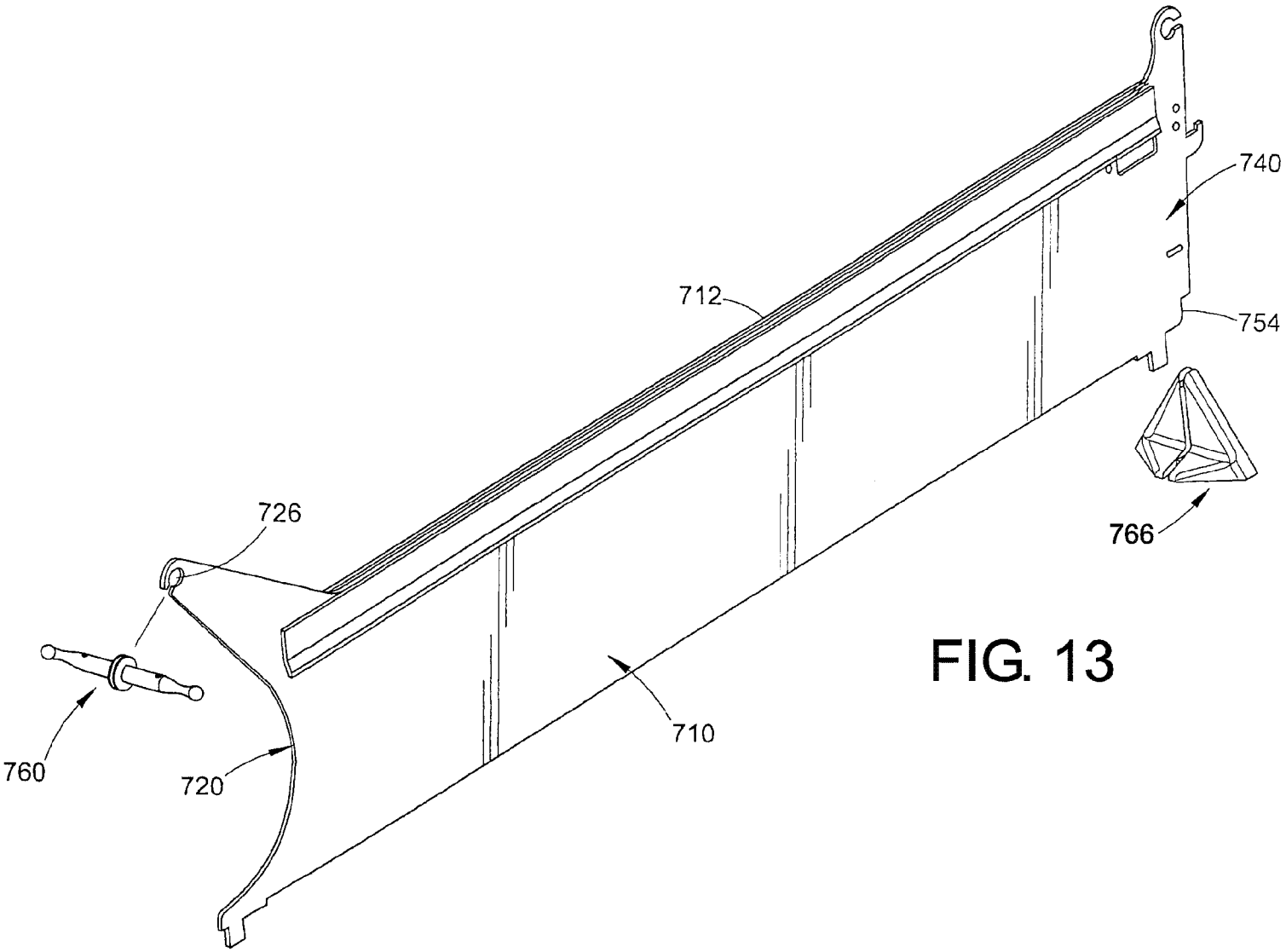
FIG. 13 is an exploded perspective view of the divider assembly of FIG. 12 together with a retaining member and a base.

With reference now to FIG. 13, selectively mounted to the front end 720 of the divider 710 is a retaining member 760. Selectively mounted to the rear end 740 is a support 766. It is apparent in FIG. 13 that the retaining member 760 is mounted in the opening 726 defined in the upper portion 724 of the front end 720. The support 766 accommodates the indented portion 754 defined in the lower portion 750 of the rear end 740 of the divider.

Figure 14:
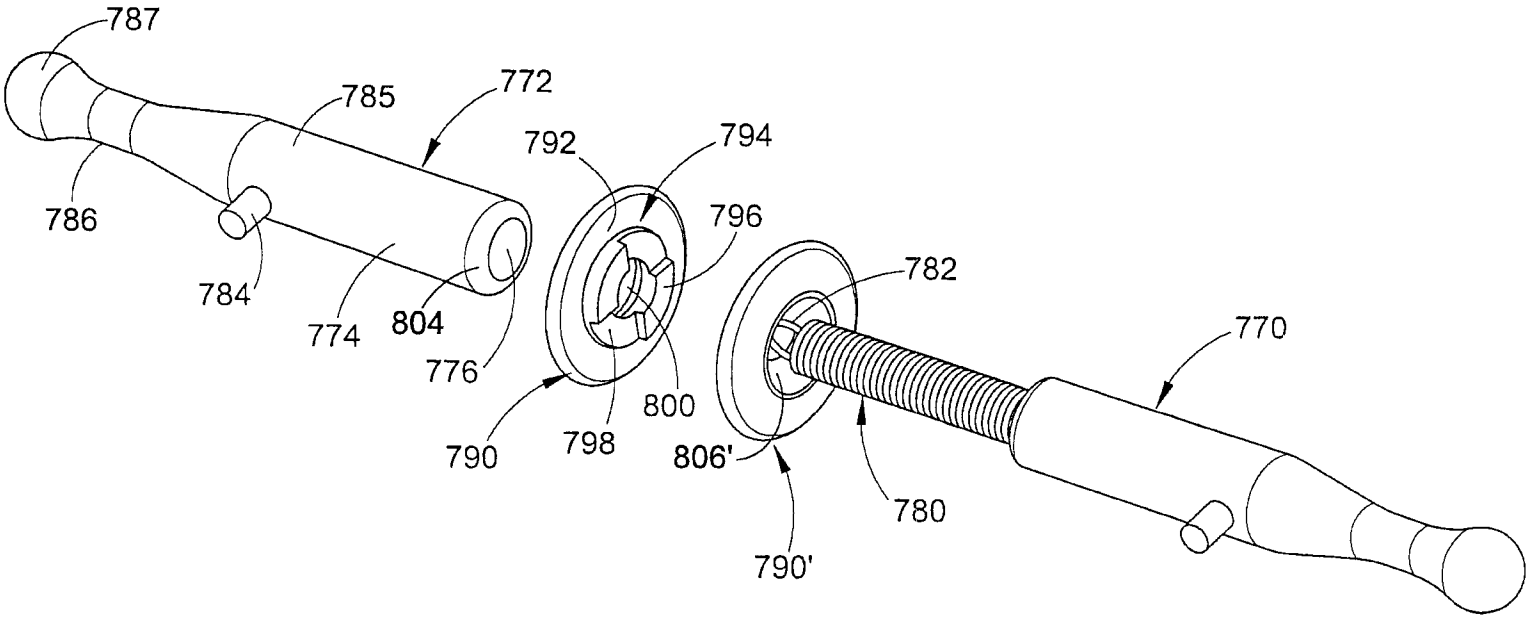
FIG. 14 is a greatly enlarged exploded perspective view of the retaining member of FIG. 13.

With reference now to FIG. 14, the retaining member 760 comprises a first section or finger 770 and a second section or finger 772. Since the two fingers are identical, only one of them will be described herein, it being appreciated that the other finger has like elements.

The finger 772 comprises a body 774 in which is defined a longitudinally extending bore 776. Accommodated in the bore is a portion of a spring, such as an extension spring 780. More particularly, an end loop 782 of the spring extends into and is mounted in the bore 776 and held therein via a pin 784. It should be appreciated that the pin 784 is shown in FIG. 14 in an extended position. When the pin is in its use condition, it extends through the loop 782 of the spring 780. Then, the pin no longer protrudes from an outer periphery of the body 774. See FIGS. 15 and 16, for example. The body includes a cylindrical first portion or shaft 785, a tapered second portion 786 having a smaller diameter than the first portion, and terminates in an enlarged or bulbous tip 787.

It should be appreciated that the spring 780 also includes a loop on the other end which is accommodated in the other finger 770 and is mounted therein using a second pin. In this way, the two fingers are resilient, each of them being able to flex or pivot in relation to the divider to which they are mounted and in relation to each other.

Figure 16:
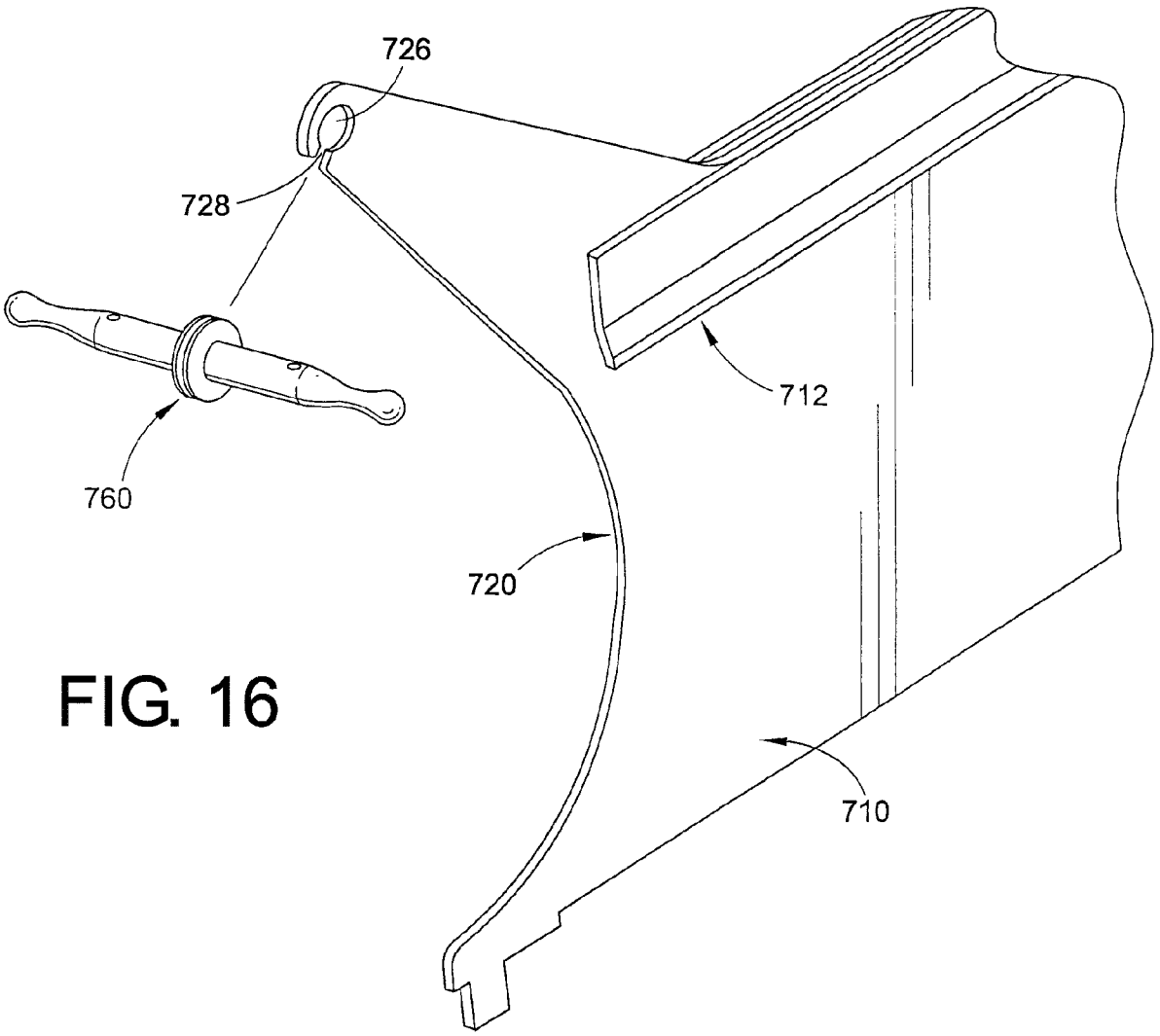
FIG. 16 is an enlarged fragmentary view of a forward portion of the divider assembly of FIG. 13.
Figure 18:
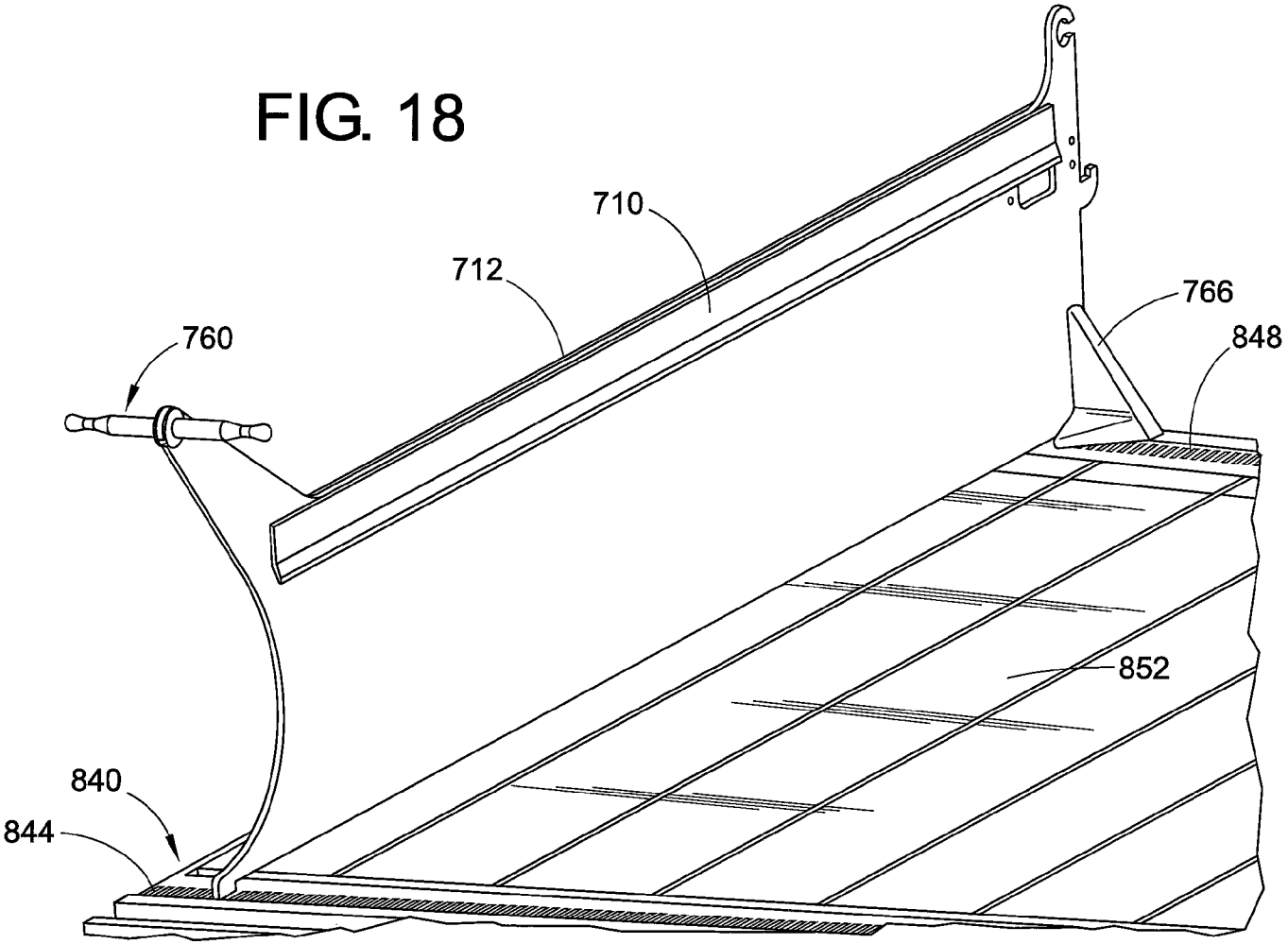
FIG. 18 is a perspective view of the divider assembly of FIG. 13 mounted on a shelf.

The fingers are capable of pivoting forwards, to allow product to be withdrawn from the shelf, as well as backwards to allow product to be restocked on the shelf. In addition, the fingers 770, 772 are capable of flexing up and down, in a direction towards a support surface of the shelf on which product is held or away from such support surface. Due to the resilient connection between the first and second fingers, they are biased to a home position as shown in FIGS. 16 and 18. However, either finger 770, 772 can individually be pivoted away from the home position while the other finger remains in the home position. Thus, product can be withdrawn from one column defined on the shelf while product in an adjacent column remains untouched.

The retaining member 760 also includes first and second end caps 790 and 790' only one of which will be described in detail herein it being appreciated that the other end cap has like elements or components. The end cap 790 comprises a face 792 from which extends a protrusion 794. The protrusion has a first section 796 of a defined height and a slotted second section 798, of a lesser height. In the design illustrated, two such slotted second sections 798 are spaced apart around the periphery of the protrusion 794.

It is evident from FIG. 14 that the protrusions 796 each include a flat or planar upper or distal surface as well as a pair of planar side walls. Similarly, the slotted second section 798 each include a planar surface for selectively accommodating the first sections 796 of the opposite end cap 790'. If desired, the side faces of the protrusion first section 796 can be angled or tapered as is evident from FIG. 5.

It should be appreciated that an aperture 800 in the end cap 790 is surrounded by the protrusion 794, which is annular or donut or ring shaped. In this way, the spring 780 can extend through the end cap and into the bore 776 defined in the finger 772. The second end cap 790 has like components. The face 792 of each end cap thus defines engaging members or contacting elements 802 as shown in FIG. 5.

With the design illustrated in FIG. 14, the two end caps are capable of rotating in relation to each other such that either the slotted second sections 798 accommodate the protruding first sections 796 on the face of the other end cap 790', such as is shown in FIG. 15 herein. Alternatively, the first sections 796 of the two end caps can contact each other thereby spacing the two fingers 770 and 772 further away from each other against the bias of the spring 780. When so positioned, the distal surfaces of the protruding first sections 796 of the two end caps 790 and 790' contact each other. In this embodiment, the end caps can be rotated by about 90° in order to selectively contact the first sections 796 with each other or selectively place the first sections 796 in the slots 798. Thus, each of the first sections or protruding sections 796 and the second sections or slots 798 can comprise approximately 90° of the total 360° circumference of the protrusion 794. While one design of such contacting surfaces has been illustrated in FIG. 14, it should be appreciated that a variety of other designs could also be employed to selectively space the two bases 790 and 790' further away from each other against the resistance or bias of the spring or biasing element 780 when that is considered desirable.

Spacing the fingers further away from each other, is advantageous when it is desired to mount the retaining member 760 in the slot 726 as shown in FIG. 16. Once the retaining member is mounted in the slot, the two end caps can be rotated in relation to each other to achieve the position shown in FIG. 15. The resilient bias of the spring 780 then holds the bases 790 and 790' together, which in turn holds the retaining member 760 in place on the divider 710. However, if the retaining member becomes damaged or otherwise needs to be replaced, it can be removed from the divider 710 simply by rotating the two end caps 790 and 790' in relation to against the bias of the spring 780 and then separating the bases from each other and then removing the retaining member 760 from the opening 726. Advantageously, therefore, the divider 710 does not need to be removed from the shelf in order to replace the retaining member 760 mounted to the divider.

In one embodiment, an end face 804 of the body 774 can be rounded and can be accommodated in a recessed rounded portion of an adjacent face of the end cap 790. See the indented rounded face 806' defined on the end cap 790'. Put another way, a ball and socket type joint is formed between the body 774 and the end cap 790. Such a joint allows a 360° pivoting motion of the finger 772 in relation to the end cap 790. The finger 770 can similarly pivot in a 360° range in relation to the end cap 790'. In other words, the fingers 770 and 772 are omnidirectionally movable in relation to their respective bases 790, 790' and in relation to the divider 710 to which the retaining member 760 can be selectively fastened or secured, as shown in FIG. 16, for example.

For such securement, it should be appreciated that a diameter of the opening or aperture 726 is sized so as to accommodate a diameter of the protrusions 794 located on each of the bases 790, 790' shown in FIG. 14. These contact each other as shown in FIG. 15. The slot 728 defined in the divider 710 can accommodate a diameter of the spring or other biasing member 780 when the first and second fingers 770 and 772 are pulled away from each other, against the bias of the biasing member, either when the retaining member is being mounted to the divider 710 or when it is removed therefrom. Further, a gap or distance 808 between the bases 790, 790' when the engaging members 802 are engaged (see FIG. 15) accommodates a thickness of the divider 710.

With reference now to FIG. 17, the support 766 comprises an upright section 810 and a base section 812 on which the upright section is supported. It should be apparent from FIG. 17 that the base section 812 protrudes away from the upright section 810. Defined in both the upright section 810 and the base section 812 is a slot 816. The slot 816 can extend generally vertically. Extending into the slot 816 is at least one protrusion 820 located on the upright section 810 of the base 766. Also located in the slot 816 is a brick-shaped support element 822 which is positioned in the base section 812 of the support 766. The slot 816 generally separates the support 766 into two halves which are connected to each other by the support element 822. The support element 822 accommodates the indented portion 754 located on the lower portion 750 of the rear end 740 of the divider 710. Also, the slot 756 in the divider 710 accommodates the protrusion 820 located in the slot 816 of the base 766. In this way, the divider 710 can be selectively mounted to the support 766.

With reference now to FIG. 18, the divider 710 can be mounted to a merchandising shelf 840 if so desired. The merchandising shelf 840 can be provided with a front grid 844 and a rear grid 848. The front grid 844 includes slots which can accommodate the finger 732 defined on the front end 720 of the divider 710. The rear grid has similar slots which can accommodate the finger 752 defined on the rear end 740 of the divider 710. In this embodiment, the merchandising shelf is a gravity fed shelf and can include a plurality of rollers 852. It should be appreciated, however, that the divider assembly disclosed herein can be used with other kinds of shelves which do not include rollers. The divider assembly can be used not only with gravity fed shelves but also with shelves employing pusher or puller mechanisms.

Figure 19:
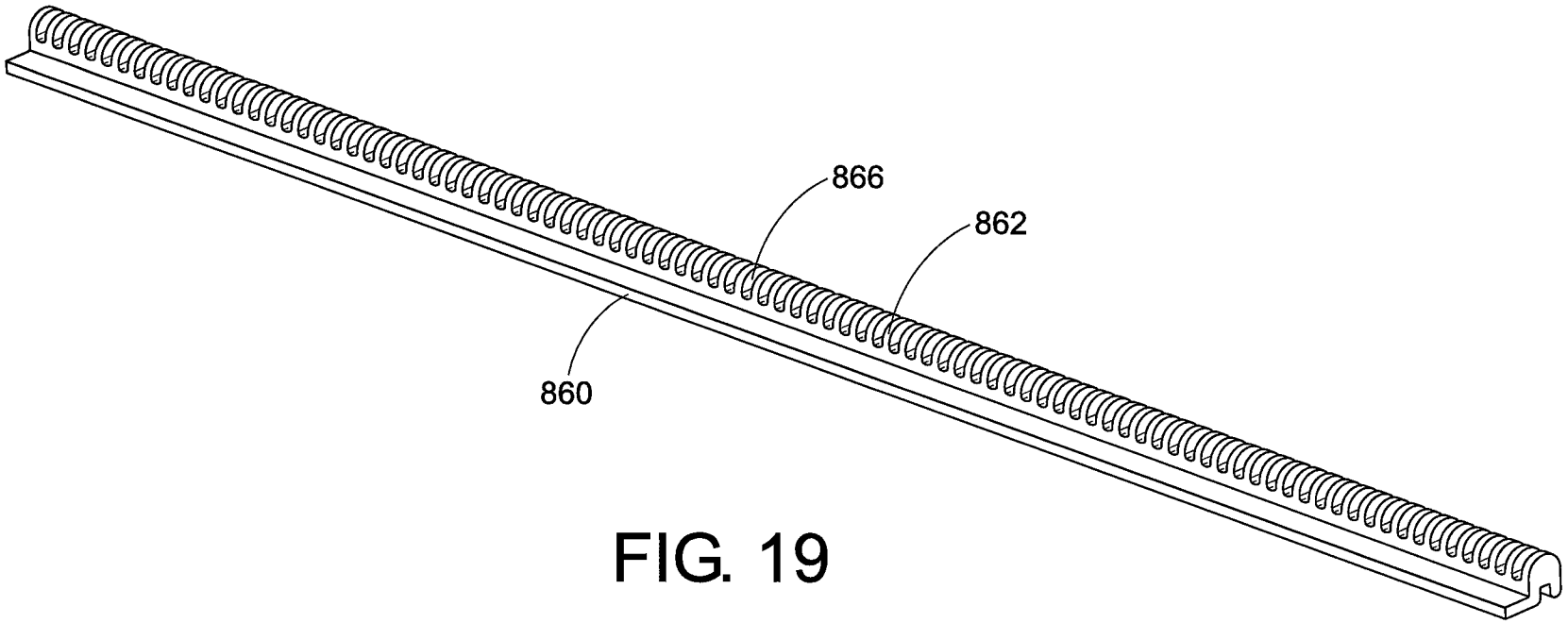
FIG. 19 is a perspective view of a connecting structure employed with the divider assembly of FIG. 18 according to the present disclosure.

With reference now to FIG. 19, there is shown a connecting member or comb 860 which includes a plurality of teeth 862 protruding between adjacent slots 866. The support element 860 can be mounted to the rear end of the divider 710.

Figure 20:
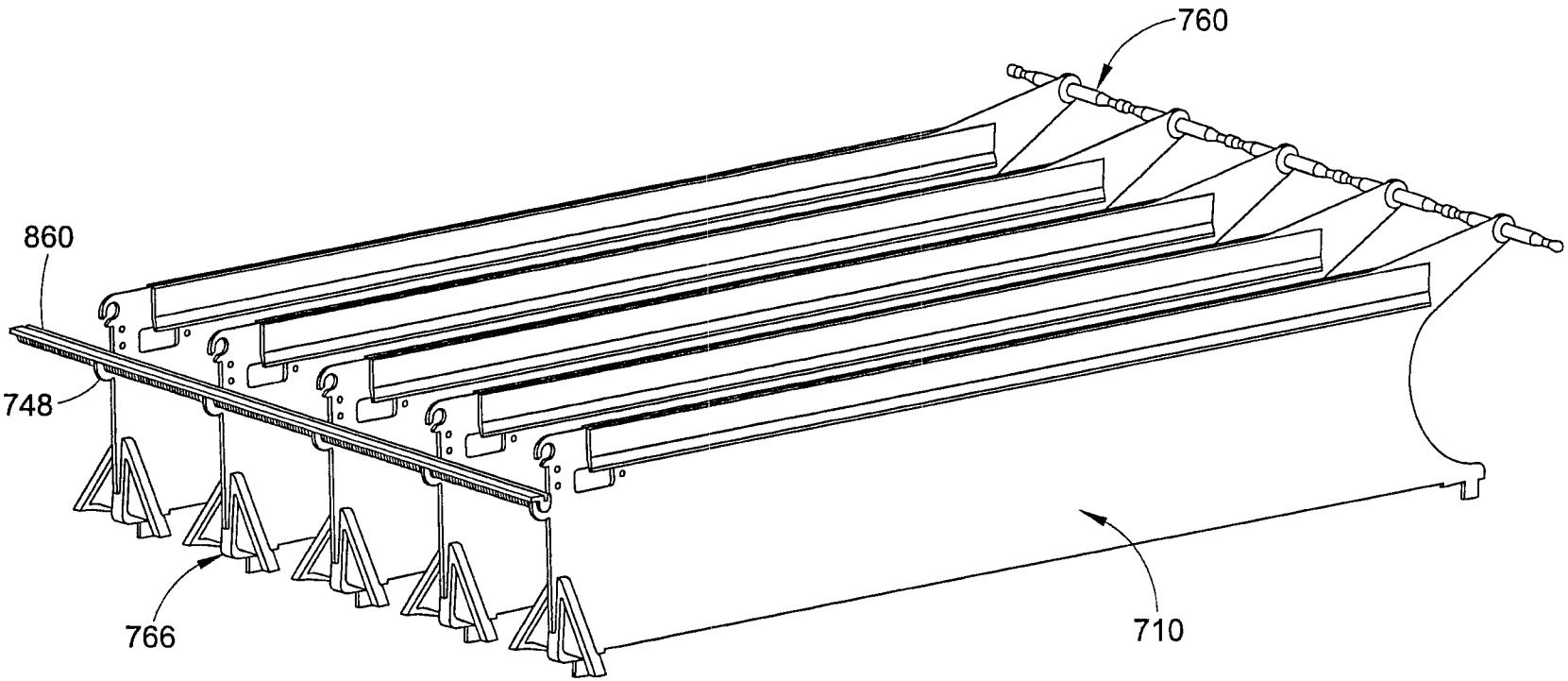
FIG. 20 is a rear perspective view of a plurality of divider assemblies according to the present disclosure connected via the connecting structure of FIG. 19.

With reference now to FIG. 20, it can be seen that a plurality of spaced dividers 710 each are supported at their rear ends by a respective base 766. In order to retard the dividers from moving laterally in relation to each other on a shelf (not illustrated in FIG. 10) the connecting element 860 is connected to each of the plurality of dividers. To this end, a finger 748 of each respective divider accommodates the connecting element 860. More particularly, the finger 748 extends into a respective slot 866 located between a pair of adjacent teeth 862 of the retaining element or comb 860.

Mounted to the front ends of the plurality of dividers 710 are respective retaining members 760. It should be apparent that adjacent fingers of a pair of retaining members extend across an opening or channel defined between each pair of dividers 710 so as to generally block that opening in the absence of a customer withdrawing a product from the shelf. However, the customer can flex the fingers of the retaining member 760 out of the way in a forward direction in order to withdraw product from the shelf on which the divider assembly is mounted. Similarly, for restocking purposes, the fingers can be flexed out of the way in a rearward direction by store personnel so as to allow a restocking of containers on a shelf. The fingers can also be flexed up away from the shelf and down towards the shelf as may be desired.

Figure 21:
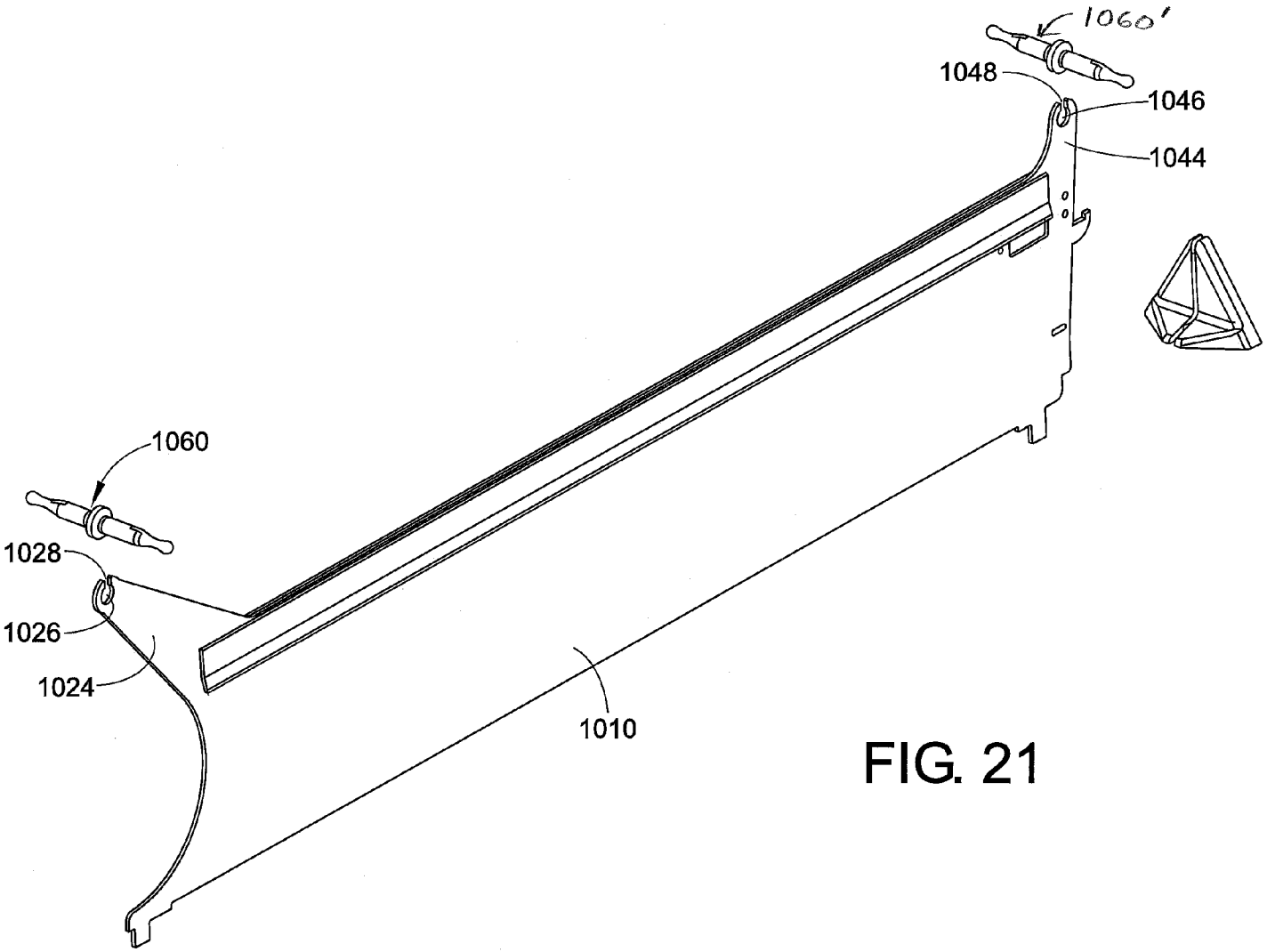
FIG. 21 is a perspective view of a divider assembly according to another embodiment of the present disclosure.

FIG. 21 illustrates another embodiment of a divider 1010 according to the present disclosure. In this embodiment, the divider comprises a protruding front upper portion 1024 in which is defined an opening or aperture 1026 extending through the divider from one face thereof to the other face thereof. Also provided is a slot 1028 that extends between an exterior surface of the divider and the opening 1026 in order to afford access to the opening. Unlike the embodiment of FIG. 12, in this embodiment, the slot 1028 is upwardly oriented. Such orientation may be advantageous to retard a detachment of a retainer 1060 once it is mounted to the divider 1010. Gravity helps to keep the retainer in place. The divider also includes a rear end that comprises a protruding upper portion 1044 in which is defined a bore or opening 1046. A slot 1048 extends upwardly from the opening 1046 to the periphery of the divider, just as on the front end of the divider.

Illustrated above the rear opening 1046 is another retainer 1060'. Provision of a retainer at the rear end of the divider 1010 is useful in order to hold or restrain product from falling off the rear end of the shelf. This can happen when the shelf has been pulled forward for restocking with product and as it is returned from its restocking position to its merchandising position upon stopping the rearward travel of the shelf, product may tumble off the rear end of the shelf, particularly stacked product.

Figure 22:
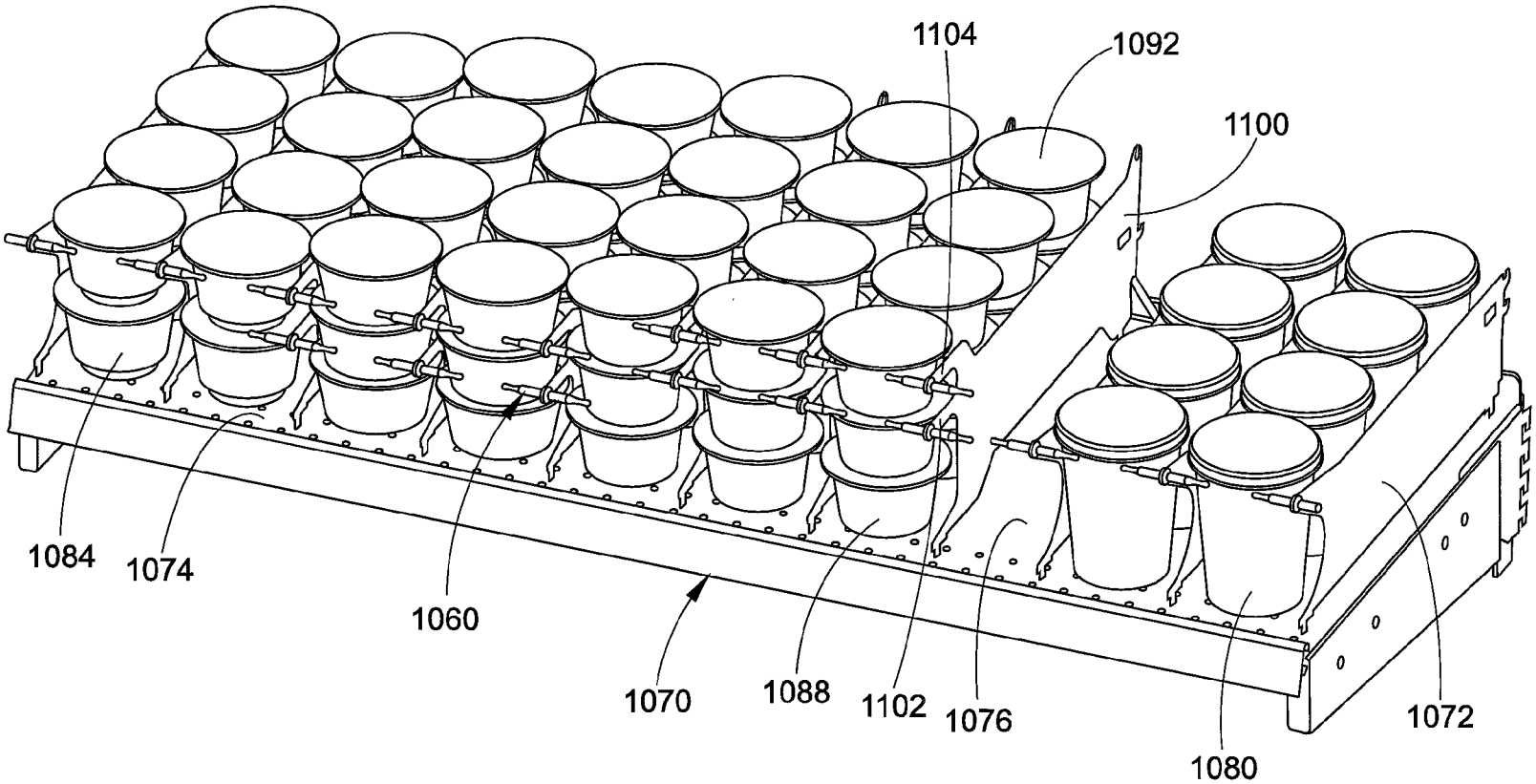
FIG. 22 is a perspective view of a product merchandiser employing the divider assembly of FIG. 21.

FIG. 22 illustrates a shelf 1070 on which are mounted a plurality of dividers such as divider 1072. The dividers are useful for organizing product on the shelf into columns 1074 held on a support surface 1076 of the shelf. It can be seen that a variety of different types of product can be held on the shelf. Such product could include a first, tall, type of product container 1080, a second, intermediate height, product container 1084 and a third, shorter, height product container 1088. It should be appreciated that the product containers can be stacked atop each other as shown with the second and third types of product containers 1084 and 1088. To this end, the product containers can be provided with flat top surfaces 1092 and similar flat bottom surfaces (not visible).

Selectively mountable on the shelf is another type of divider 1100. This type of divider comprises a front end including spaced first and second arms 1102 and 1104. Each of the arms is adapted to hold a respective retainer 1060. One benefit of providing spaced first and second arms 1102 and 1104 is to enable the divider to accommodate product containers of different heights. As is evident from FIG. 22, for containers stacked three high the double arm arrangement, with each arm accommodating a retainer 1060 is advantageous. It should be appreciated that any desired configuration of a divider could be provided to accommodate one or a multiple of retainers at either the front of the rear end of the divider as may be deemed advantageous for a particular merchandising environment.

Figure 23:
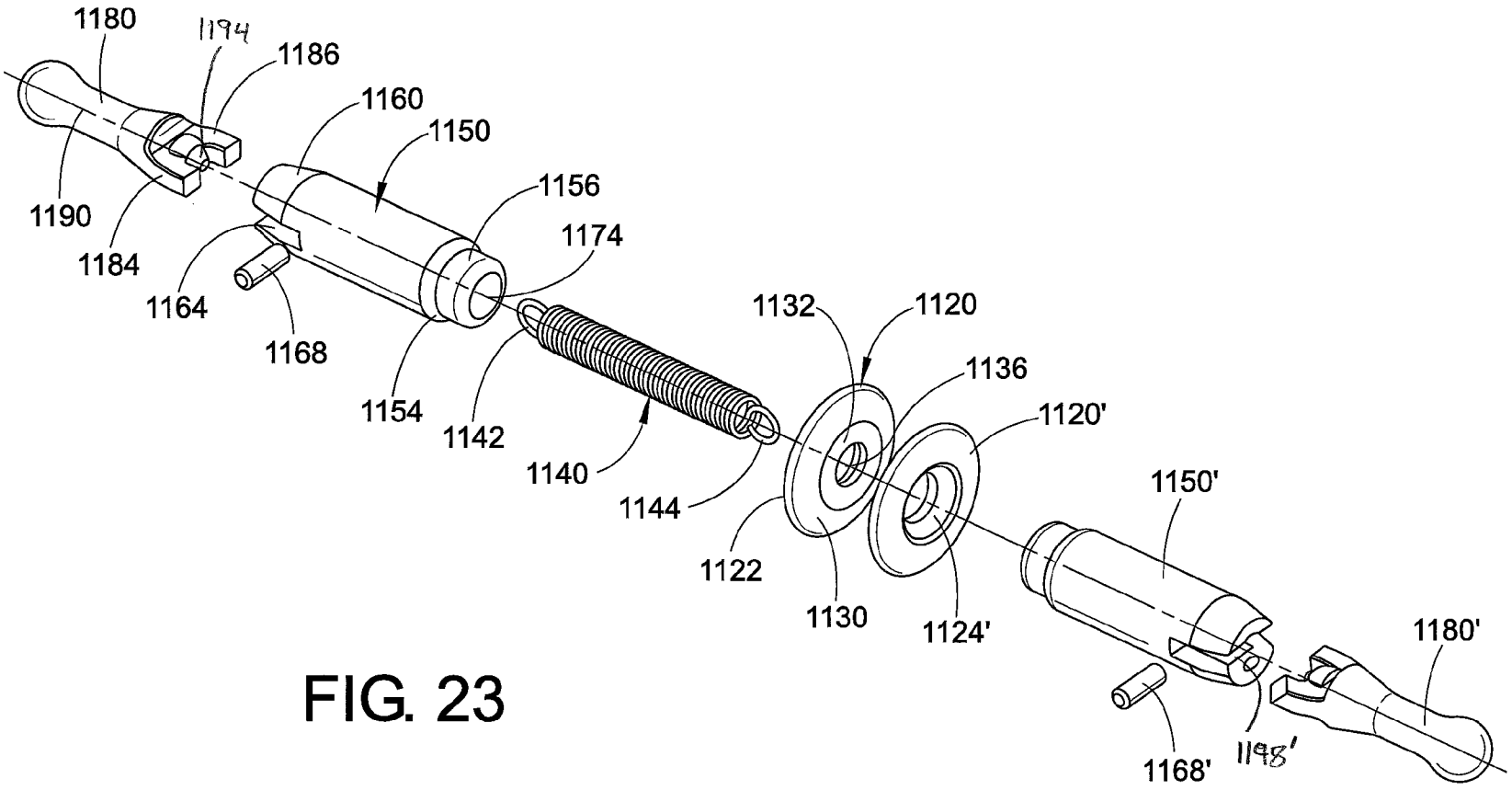
FIG. 23 is an enlarged exploded perspective view of a retaining member of the divider assembly of FIG. 21.

Finally, with reference to FIG. 23, another embodiment of a retaining member is there illustrated. In this embodiment, the retaining member comprises first and second retainer elements or fingers. Since the two sections of the retainer are mirror images of each other, only one section will be described herein in detail, it being appreciated that the other section of the retaining member has like components.

The retainer element first section comprises a first base 1120, including a first face 1122 which is generally planar but includes an indented portion, shown at 1124' on the second base 1120'. The base also includes a second face 1130 on which is defined an annular or ring-shaped protrusion 1132 having a planar top face. A bore 1136 extends axially through the base. The retainer also comprises a biasing element. In this embodiment, the biasing element comprises a spring 1140 which can be in the form of a tension spring. The spring 1140 includes on a first end a first loop 1142 and on a second end a second loop 1144. Accommodating a portion of the first spring is a first body 1150 which comprises a first end 1154 on which is defined a tapered section 1156. The body 1150 also includes a second end 1160 in which is defined a pair of slots 1164 (only one being visible). A pin 1168 is adapted to be mounted in the slots so that it extends across the body. It should be appreciated that a bore 1174 extends longitudinally through the body such that the body comprises a hollow cylinder.

The spring first loop 1142 is adapted to extend around the pin 1168 such that the pin holds that end of the spring in place in the body. Similarly, a second body 1150' accommodates a second pin 1168' through which the second loop 1144 of the spring extends. Once the spring or other biasing element has been successfully installed in the respective body 1150, 1150' of the retaining member, the respective body can be closed off by a tip 1180, 1180'. To this end, the tip comprises a pair of legs 1184 and 1186, which are mounted in the respective slots 1164 in the body second end 1160, thus holding the respective pin 1168 and 1168' in place.

Once this is done, the spring becomes trapped and holds the pair of bodies to their respective bases and holds the bases in an adjoining relationship with each other. The spring thus extends through the bores 1136 in the respective bases and through the hollow interiors of the respective bodies 1150 and 1150'. In the rest position of the retaining member, with the spring 1140 in its least extended orientation, a longitudinal axis 1190 extends through both of the bodies 1150, 1150' and both of the bases 1120 and 1120'. In order to secure the tips 1180 and 1180' to the respective bodies 1150 and 1150', the tips can be provided with respective protrusions 1194 which cooperate with ledges in the respective bodies, one such ledge 1198' being shown on the body 1150'. In this way, a snap-fit arrangement is provided for the respective tips and bodies.

As with the previous embodiment, the bodies, which can also be termed fingers 1150 and 1150' are capable of pivoting omnidirectionally in relation to their respective bases 1120 and 1120'. Due to the resilient connection between the two bodies or fingers, they are biased to a home position in which a common axis 1190 extends through the two bodies 1150 and 1150', the two bases 1120 and 1120', and the two tips 1180 and 1180'. However, the fingers are capable of pivoting away from their respective base each individually and in a variety of acute orientations in relation to the base.

In this embodiment, in order to install or remove the retainer assembly from a divider, the two bases 1120 and 1120' can be separated from each other such that the spring 1140 is exposed. Then the retainer can be removed from the divider via the slot provided in the divider, because the diameter of the spring is smaller than is a width of the slot. It should also be appreciated that the diameters of the annular protrusions 1130 provided on each of the bases are sized so that they are adapted to be accommodated in the bore or opening 1026, defined in the divider 1010 so as to hold the retainer in place on the divider.

With reference again to FIG. 22, at the two end dividers, the adjacent retainers or fingers have the conventional shape on the side of the divider facing the containers 1080 and 1084. However, on the opposite side of the respective divider 1072, a shortened version of a retainer or other member is illustrated. This simply serves as a base to which the resilient member is mounted because retainers are not needed on the far sides of the two end dividers. Thus, a shortened version of a retainer-like member can be provided with a hollow interior or cavity into which one end of the resilient member can extend, so that one end thereof can be secured in place. The opposite end of the resilient member is connected to a retainer member which can move omnidirectionally as has been discussed above. Of course, it should be apparent that other types of housings could be provided on the far sides of the dividers provided on opposed sides of a shelf, such as the shelf 1170, while still allowing the retainers mounted to such end dividers to move omnidirectionally.

The product merchandiser illustrated herein allows shelving to be stacked closely together as withdrawal of the product containers does not involve much upward movement of the containers to clear a barrier. Instead, the containers can be simply tilted and then withdrawn from the merchandising structure in a generally horizontal direction. This allows the merchant to increase the product density in the store, which is very desirable, as shelves can be stacked more closely together and more products can be offered to potential customers.

In the embodiments disclosed herein, the several versions of the movable retainer each extend across at least a portion of the width of a channel defined on the support member or shelf between a pair of facing dividers or side walls. In several embodiments, the retainer is pivotally attached to front portions of the side walls. The retainer can flex outwardly to allow product to be withdrawn from the shelf by a consumer and flex inwardly to allow restocking. Notably, movement of the retainer is omnidirectional. The several versions allow the retainer to move from a first position retarding forward movement of merchandise in a channel to a second position allowing such movement and a third position allowing restocking of product. The movement of the retainer allows food containers as well as other types of merchandise to be withdrawn from and stocked on a merchandising structure such as a shelf or another support member.

The present disclosure has been described with reference to several embodiments. Obviously, modifications and alterations will occur to others upon the reading and understanding of the preceding detailed description. It is intended that the present disclosure be construed as including all such modifications and alterations insofar as they come within the scope of the appended claims or the equivalents thereof.

What is claimed is:

1. A retainer assembly for an associated merchandising shelf comprising:

a generally planar elongated divider mounted to the associated shelf; a first retainer mounted to a first side of the divider; a second retainer mounted to a second side of the divider; wherein the first and second retainers are connected together by a biasing member and are biased by the biasing member into an orientation normal to a plane of the divider in a rest position when no external force is applied to the first or second retainers and each of the first and second retainers is adapted to pivot omnidirectionally in relation to the plane of the divider when an external force is applied to the first or second retainers;

wherein the biasing member and the first and second retainers lie along a common axis of the first and second retainers in the rest position;

wherein the biasing member comprises a coiled spring or elastic band;

wherein in use associated products are held in place by either or both of the first and second retainers in order to retard the associated products from falling off the associated shelf and each of the first and second retainers are adapted to pivot omnidirectionally to facilitate removal of the associated products from the associated shelf resulting in an external force being applied to the first or second retainers.

2. The assembly of claim 1 wherein the first and second retainers each comprise a body and a base, the body being movable in relation to the base, wherein the body and base of the respective first and second retainers both lie along a common axis in a rest position of the first and second retainers.

3. The assembly of claim 2 wherein said biasing member extends along the common axis.

4. The assembly of claim 3 wherein a cavity is defined in the body of at least one of the first and second retainers.

5. The assembly of claim 4 wherein the biasing member extends into the cavity in the body of the at least one of the first and second retainers.

6. The assembly of claim 5 wherein said biasing member comprises a spring which comprises a first end connected to the body of the first retainer and a second end connected to the body of the second retainer.

7. The assembly of claim 6 wherein said spring first end comprises a first loop which cooperates with a first pin to hold the spring first end in the cavity of the body of the at least one of the first and second retainers.

8. A retainer assembly for a merchandising shelf having a support surface wherein associated products stored on the support
surface are urged forward toward a front end of the shelf for easy access and removal of the products, the retainer assembly comprising:

a generally planar elongated first divider mounted to the shelf;

a generally planar elongated second divider mounted to the shelf, wherein the first and second dividers are spaced from each other and define between them a longitudinal pathway or channel along which an associated product is adapted to travel from a rear position to a front position on the shelf;

a first finger mounted to the first divider;

a second finger mounted to the second divider so that the first and second fingers face each other;

wherein the first and second fingers are independent of each other and are each movable to a plurality of positions so that in a first position, the first and second fingers extend perpendicular from the respective first and second dividers into the pathway and at least partially obstruct the pathway thereby retarding further forward movement of the associated products, in a second position, the first and second fingers move omnidirectionally at an acute angle in relation to the pathway to allow further forward movement of the associated products for removal of same from the shelf, and in a third position, the first and second fingers move omnidirectionally at an acute angle in relation to the pathway to allow a restocking of the associated products on the shelf;

a first and second biasing member each comprising a coiled spring or an elastic band;

wherein the first finger comprises a first body portion and a first biasing member
and the second finger comprises a second body portion and a second biasing member, said first and second biasing member respectively urging said first and second body portions into the first position, wherein the first and second biasing member is coaxial with the first and second body portions when in the first position.

9. A retainer assembly for a merchandising structure having a support surface the retainer assembly comprising:

a first divider mounted to an associated support structure;

a second divider mounted to the associated support structure, wherein the first and second dividers are spaced from each other and define between them a longitudinal pathway or channel along which an associated item of merchandise can travel from a rear position to a front position on the associated support structure;

a first finger mounted to the first divider;

a second finger mounted to the second divider so that the first and second fingers face each other;

wherein the first and second fingers are independent of each other and are each movable to a plurality of positions so that in a first position, they are adapted to extend normal to the pathway and at least partially obstruct the pathway thereby retarding further forward movement of the associated item of merchandise, in a second position, they are adapted to move omnidirectionally at an acute angle in relation to the pathway to allow further forward movement of the associated item of merchandise for removal of same from the associated shelf, and in a third position, they are adapted to move omnidirectionally at an acute angle in relation to the pathway to allow a restocking of the associated item of merchandise on the associated support structure; and, wherein the first finger comprises a first body portion and a first biasing member and the second finger comprises a second body portion and a second biasing member, said first and second biasing members respectively urging said first and second body portions into the first position, wherein the first and second biasing members are coaxial with the first and second body portions when in the first position; and wherein at least one of the first and second biasing members comprises a tension spring.

10. The assembly of claim 9 wherein the first and second fingers are adapted to extend in a fourth position in which a tip of each of the first and second fingers extends towards the associated support surface.

11. The assembly of claim 9 wherein the first and second fingers are adapted to extend in a fifth position in which a tip of each of the first and second fingers extend away from the associated support surface.

12. The assembly of claim 9 wherein the first and second fingers each include a base.

13. The assembly of claim 12 wherein the first and second body portions are movably mounted on their respective base.

14. A retainer assembly for an associated merchandising structure, comprising;

a generally planar elongated divider mounted to the associated merchandising structure;

a first retainer mounted to a first side of the divider;

a second retainer mounted to a second side of the divider;

wherein the first and second retainers extend along a common axis when in a rest position; and a biasing member which extends along the common axis and includes a first end connected to the first retainer, and spaced therefrom, a second end connected to the second retainer such that the biasing member connects the first and second retainers to each other; wherein the biasing member comprises a coiled spring or elastic band; and wherein the divider includes an aperture along the common axis through which the biasing member extends;

wherein in use associated products are held in place by either or both of the first and second retainers in order to prevent the associated products from falling off the associated merchandising structure and the first retainer and second retainer pivot upwardly, downwardly and diagonally with respect to the common axis to facilitate removal of the associated products from the associated merchandising structure.

15. The retainer assembly of claim 14 further comprising;

a first base on which the first retainer is mounted; and a second base on which the second retainer is mounted.

16. The retainer of claim 15 wherein at least one of the first and second bases comprises an indented rounded face and the associated one of the first and second retainers includes a rounded proximal end face adapted to move in relation to the indented rounded face of the at least one of the first and second bases.

17. The retainer of claim 14 wherein the divider includes a front end and a rear end and wherein the first and second retainers are mounted adjacent the front end of the divider.

* * * * *